US005696874A

United States Patent [19]

Taguchi

[11] Patent Number: 5,696,874

[45] Date of Patent: Dec. 9, 1997

[54] MULTIPULSE PROCESSING WITH FREEDOM GIVEN TO MULTIPULSE POSITIONS OF A SPEECH SIGNAL

[75] Inventor: Tetsu Taguchi, Tokyo, Japan

[73] Assignee: NEC Corporation, Tokyo, Japan

[21] Appl. No.: 354,105

[22] Filed: Dec. 6, 1994

[30] Foreign Application Priority Data

Dec. 10, 1993 [JP] Japan ..... 5-341315

[51] Int. Cl.[6] ..... G10L 9/02

[52] U.S. Cl. ..... 395/2.28

[58] Field of Search ..... 381/30, 31, 36, 381/38; 395/2.28, 2.31, 2.74

[56] References Cited

U.S. PATENT DOCUMENTS

| | | | |
|---|---|---|---|
| 4,720,865 | 1/1988 | Taguchi . | |
| 4,797,926 | 1/1989 | Brouson et al. | 381/36 |
| 4,821,324 | 4/1989 | Ozawa et al. | 381/31 |
| 4,908,863 | 3/1990 | Taguchi et al. | 381/36 |
| 4,932,061 | 6/1990 | Kroon et al. | 381/30 |
| 4,945,565 | 7/1990 | Ozawa et al. | 381/38 |
| 4,991,215 | 2/1991 | Taguchi | 381/38 |
| 5,119,424 | 6/1992 | Asakawa et al. | 381/34 |
| 5,142,584 | 8/1992 | Ozawa | 395/2.31 |
| 5,202,953 | 4/1993 | Taguchi | 395/2 |
| 5,307,441 | 4/1994 | Tzeng | 395/2.31 |
| 5,351,338 | 9/1994 | Wigren | 395/2.28 |

FOREIGN PATENT DOCUMENTS

| | | |
|---|---|---|
| 0195487 | 9/1986 | European Pat. Off. . |
| 2173679 | 10/1986 | United Kingdom . |
| 2195220 | 3/1988 | United Kingdom . |
| 2195518 | 4/1988 | United Kingdom . |

OTHER PUBLICATIONS

"A new model of LPC excitation of producing natural--sounding speech at low bit rates", by Atal et al., IEEE ICASSP, Int. Conf. on Acustics, Speech, & Signal Processing, pp. 614–617.

"Speech Coding Based on Multi–pulse Excitation Method:, Institute of Electronics & Communication Engineers of Japan", CAS82–202, Mar. 1983, pp. 115–122.

*Primary Examiner*—Allen R. MacDonald
*Assistant Examiner*—Susan Wieland
*Attorney, Agent, or Firm*—Sughrue, Mion, Zinn, Macpeak & Seas, PLLC

[57] ABSTRACT

In a multipulse processing device for achieving a high encoding efficiency without using a high sampling frequency for an input signal and with a great degree of freedom given to positions of multipulses, an input speech signal is subjected by an LPC analyzer/processor 3 to LPC analysis of each analysis frame for extraction of LPC coefficients after sampled by an A/D converter 2. Multipulses are retrieved as a result of decision by a multipulse analyzer 20 with a degree of freedom given relative to sampling points of a sampled speech signal supplied through an auditorily weighting filter 4. Encoded by an encoder 41 and together with k parameters used as an example of the LPC coefficients, retrieved multipulses are multiplexed by a multiplexer 42 for delivery to a synthesis side. A multipulse waveform synthesizer 45 synthesizes a waveform by using decoded multipulse data and the LPC coefficients.

36 Claims, 18 Drawing Sheets

MULTIPULSE PROCESSING WITH FREEDOM GIVEN TO MULTIPULSE POSITIONS OF A SPEECH SIGNAL

BACKGROUND OF THE INVENTION

This invention relates to a multipulse processing method, a device, an analyzer, and a synthesizer therefor and, more particularly, to a multipulse processing method of encoding with a high efficiency, a speech signal based on spectrum envelope information extracted by analysis and linear predictive analysis of each analysis frame, a device, an analyzer, and a synthesizer therefor.

In band compression of a speech signal, it is requested to encode the speech signal at a low bit rate, such as below 16 kbps, for transmission. For encoding and transmission of the speech signal at the low bit rate and for achievement on a receiving side of an excellent quality of reproduction, multipulse processing is known (for example, B. S. Atal et al, "A New Model of LPC Excitation for Producing Natural-sounding Speech at Low Bit Rates", 1982 IEEE ICASSP (Int. Conf. on Acoustics, Speech, and Signal Processing) Proceedings, pages 614 to 617).

According to this multipulse processing method, the speech signal is divided for transmission into spectrum envelope information and excitation source information with the excitation source information represented by a plurality of pulses (multipulses) which have a degree of freedom in amplitude and position. The spectrum envelope represents spectrum distribution information of vocal tract by which the speech signal is produced. The excitation source information represents fine structures of the spectrum envelope and includes strength of the excitation source, pitch periods, and voiced/unvoiced information.

The main theme of the multipulse processing method is to extract with a reasonable amount of calculation the multipulses of an excellent efficiency of encoding. For extraction of the multipulses, various methods are known. An example is an A-b-S (Analysis by Synthesis) method described in the B. S. Atal et al reference. Alternatively, pulse search is carried out in a correlation domain (Ozawa et al, "Marutiparusu Kudôgata Onsei Hugôka no Kentô (Speech Coding Based on Multi-pulse Excitation Method)", Institute of Electronics and Communication Engineers of Japan, CAS82-202 (March 1983)). Still another is disclosed by the present inventor in U.S. Pat. No. 4,720,865, in which attention is directed to a similarity measure, such as cross-correlation coefficients or normalized autocorrelation coefficients. It is desired in such multipulse processing methods to improve the efficiency of encoding.

In a conventional multipulse processing method which will later be described in detail, the freedom given to positions of the multipulses is confined by sampling instants at which the speech signal is sampled on the analyzing side. This reduces the efficiency of encoding of sampling on the analyzing side. As a countermeasure for obviating the confinement imposed in phase on analysis frames here and there in the analyzing side, it is possible to sample the speech signal at a higher sampling frequency which is largely higher than the Nyquist rate.

In a different conventional multipulse processing method which will also later be described, use is made of a sampling frequency that is far higher than the Nyquist rate. In the different conventional processing method, it is possible to raise the freedom given to the positions of multipulses. It is, however, indispensable to raise an order (the number) of the LPC filter coefficients provided that a prediction interval of the speech signal is kept unchanged. This reduces the efficiency of encoding of the spectrum envelope information despite widening of the freedom given to the positions of multipulses by sampling as above the speech signal at the sampling frequency which is far higher than the Nyquist rate. As a consequence, the efficiency of encoding is eventually reduced.

SUMMARY OF THE INVENTION

It is therefore an object of the instant invention to widen a degree of freedom given to positions of multipulses without use of a high-rate sampling frequency for an input speech signal and to provide a multipulse processing method having an excellent efficiency of encoding.

It is another object of this invention to provide a multipulse encoding device which is used in carrying out the multipulse processing method.

It is still another object of this invention to provide a multipulse decoding device which is used in carrying out the multipulse processing method.

It is a further object of this invention to provide a multipulse analyzer which is used in carrying out the multipulse processing method.

It is a still further object of this invention to provide a multipulse synthesizer which is used in carrying out the multipulse processing method.

Other objects of this invention will become clear as the description proceeds.

A multipulse processing method to which this invention is applicable is for multipulse encoding an input speech signal on an analyzing side into an encoded speech signal for multipulse synthesis of the encoded speech signal on a synthesizing side into a synthesized speech signal equivalent to the input speech signal. The multipulse processing method comprises on the analyzing side the following steps. The input speech signal is sampled into a sampled speech signal at a predetermined sampling frequency defining successive analysis frames. LPC analysis is done on the sampled speech signal of each analysis frame to extract LPC coefficients and to produce original spectrum envelope information of the input speech signal based on the LPC coefficients. The LPC coefficients are multipulse analyzed into a sequence of original multipulses having appearance time instants and multipulse amplitudes in correspondence in each analysis frame to features of excitation source information representative of speech information of the input speech signal in combination with the spectrum envelope information. The sequence of original multipulses and the spectrum envelope information are then encoded into an encoded sequence of original multipulses and encoded spectrum envelope information for use in combination as the encoded speech signal.

According to this invention, the multipulse analyzing step comprises the step of giving a degree of freedom to the appearance time instants relative to sampling instants of the sampled speech signal to modify the original multipulses into modified multipulses to make the encoded sequence comprise the modified multipulses in place of the original multipulses.

A multipulse encoding device to which this invention is applicable comprises sampling means for sampling an input speech signal into a sampled speech signal at a predetermined sampling frequency defining successive analysis frames. The invention further includes LPC analyzing means for LPC analyzing the sampled speech signal of each analysis frame to extract LPC coefficients and to produce spectrum envelope information of the input speech signal based on the LPC coefficients. Multipulse analyzing means of the invention multipulse analyze the LPC coefficients into a multipulse sequence of multipulses having appearance time instants and multipulse amplitudes in correspondence in each analysis frame to features of excitation source information representative of speech information of the input speech signal in combination with the spectrum envelope information encoding means then encode the excitation source information into an encoded sequence to produce the encoded signal and the spectrum envelope information as an encoded speech signal.

According to this invention, the multipulse analyzing means comprises freedom giving means for giving a degree of freedom to the appearance time instants relative to sampling time instants of the sampled speech signal to make the encoding means use the excitation source information in which the appearance time instants of the multipulses are given the degree of freedom.

A multipulse decoding device to which this invention is applicable is for decoding an encoded speech signal produced by a multipulse encoder as a combination of an encoded sequence of modified multipulses and encoded spectrum envelope information by sampling an original speech signal into a sampled speech signal at a predetermined sampling, frequency defining successive analysis frames. The sampled speech signal of each analysis frame is LPC analyzed to extract the LPC coefficients and for production of original spectrum envelope information of the original speech signal based on the LPC coefficients. The LPC coefficients are multipulse analyzed into original multipulses having appearance time instants and multipulse amplitudes in correspondence in each analysis frame to features of excitation source information representative of speech information of the original speech signal in combinations with the original spectrum envelope information. The original multipulses into modified multipulses of a sequence with the appearance time instants given a degree of freedom, and by encoding the modified multipulses into the encoded sequence of modified multipulses and the original spectrum envelope information into the encoded spectrum envelope information.

According to this invention, the multipulse decoding device comprises decoding means for decoding the encoded sequence into a decoded sequence of modified multipulses and the encoded spectrum envelope information into decoded spectrum envelope information and multipulse waveform synthesizing means for synthesizing the decoded sequence of modified multipulses and the decoded spectrum envelope information into a synthesized speech signal equivalent to the original speech signal.

A multipulse analyzer to which this invention is applicable comprises sampling means for sampling an input speech signal into a sampled speech signal at a predetermined sampling frequency defining successive analysis frames. LPC analyzing means LPC analyzes sampled speech signal of each analysis frame to extract LPC coefficients and to produce spectrum envelope information based on the LPC coefficients. A multipulse analyzing means multipulse analyzes the LPC coefficients into a multipulse sequence of multipulses having appearance time instants and multipulse amplitudes in correspondence in each analysis frame to features of excitation source information representative of speech information of the input speech signal in combination with the spectrum envelope information.

According to this invention, the multipulse analyzing means comprises freedom giving means for giving a degree of freedom to the appearance time instants to modify the multipulses into modified multipulses relative to sampling instants of the sampled speech signal with the appearance time instants given the degree of freedom and with the multipulse amplitudes as they are.

A multipulse synthesizer to which this invention is applicable is for multipulse synthesizing a sequence of modified multipulses and spectrum envelope information produced by a multipulse analyzer by sampling an original speech signal into a sampled speech signal at a predetermined sampling frequency defining successive analysis frames. The sampled speech signal of each analysis frame are LPC analyzed to extract LPC coefficients and for production of the spectrum envelope information based on the LPC coefficients, by multipulse analyzing the LPC coefficients into original multipulses having appearance time instants and multipulse amplitudes in correspondence in each analysis frame to features of excitation source information representative of speech information of the original speech signal in combination with the spectrum envelope information. The original multipulses are then modified into the modified multipulses of the sequence with the appearance time instants given a degree of freedom.

According to this invention, the multipulse synthesizer comprises multipulse waveform synthesizing means for synthesizing the sequence of modified multipulses and the spectrum envelope information into a synthesized speech signal equivalent to the original speech signal.

DESCRIPTION OF THE PREFERRED EMBODIMENTS

Figure 1:
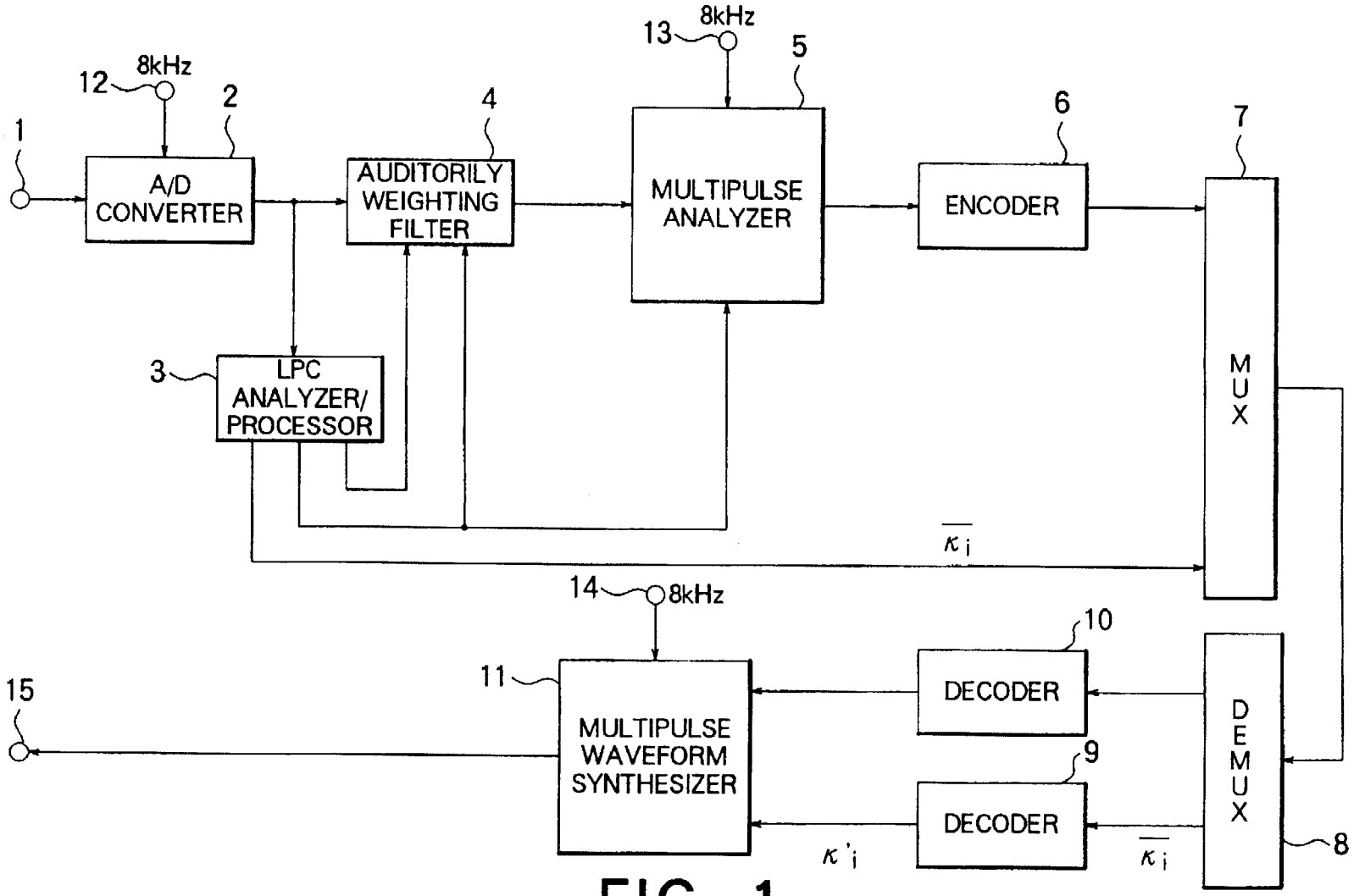
FIG. 1 PRIOR ART
FIG. 1 is a block diagram of a multipulse processing device for carrying out a conventional multipulse processing method.

Referring to FIG. 1, description will first be made as regards a conventional multipulse processing method. In the figure, a speech signal is supplied through an input terminal 1 to an A/D converter 2. An analyzing side comprises in addition an LPC (Linear Predictive Coding) analyzer/processor 3, an auditorily weighting filter 4, a multipulse analyzer 5, an encoder 6, and a multiplexer 7. A synthesizing side comprises a demultiplexer 8, decoders 9 and 10, and a multipulse waveform synthesizer 11.

Through the input terminal 1, the speech signal is delivered to the A/D converter 2 to be band-limited by a built-in low-pass filter (LPF) to a frequency below 3.4 kHz and is sampled at a sampling frequency of 8 kHz supplied through an input terminal 12. This sampled speech signal is delivered to the LPC analyzer/processor 3 and to the auditorily weighting filter 4.

The LPC analyzer/processor 3 subjects each analysis frame of the sampled speech signal to linear predictive encoding (LPC) to calculate quantized k parameters $\bar{k}_i$ (i=1, 2, . . . , P), α parameters $\alpha_i$ (i=1, 2, . . . , P), and attenuation α parameters $\gamma^i\alpha_i$ (i=1, 2, . . . , P), where P represents a degree or dimension of LPC analysis. The quantized k parameters are delivered to the multiplexer 7; the α parameters and the attenuation α parameters, to the auditorily weighting factor 4; and the attenuation α parameters, to the multipulse analyzer 5.

The auditorily weighting filter 4 has a transfer function W(Z) given below in order to preliminarily modify (auditorily weight) the sampled speech signal in its spectral structure. This is for using human auditory sense in reducing encoding noise resulting from encoding of the speech signal.

$$W(Z)=\left(1-\sum_{i=1}^{P}\alpha_i Z^{-1}\right)/\left(1-\sum_{i=1}^{P}\gamma^i\alpha_i Z^{-1}\right), \quad (1)$$

where Z represents Z=exp(jλ) used in a Z-transform representation of the transfer function $H(Z^{-1})$, where in turn λ=2 πΔTf in which ΔT represents an inverse number of the sampling frequency and f represents the frequency. Incidentally, γ represents an attenuation factor which decides a degree of weighting, γ being greater than zero and not greater than unity. When γ is equal to unity, W(Z) is equal to 1 in Equation (1). It is possible in this event to omit the auditorily weighting filter 4.

The multipulse analyzer 5 is supplied as its input signal with the sampled speech signal which is auditorily weighted by the auditorily weighting filter 4. This input signal is multipulse analyzed in the known manner by a clock signal of 8 kHz supplied through another input terminal 13 and the attenuation α parameters $\gamma^i\alpha_i$ supplied from the LPC analyzer/processor 3. Analyzed, multipulses are delivered to the encoder 6.

The encoder 6 quantizes amplitudes and positions of the multipulses for supply to the multiplexer 7. Multiplexing these quantized data and the quantized k parameters supplied from the LPC analyzer/processor 3, the multiplexer 7 sends a multiplexed datum through a transmission channel towards the demultiplexer 8.

Demultiplexing the multiplexed datum into the quantized data and k parameters, the demultiplexer 8 delivers the quantized k parameters to the decoder 9 and the quantized data to the decoder 10. Decoding the quantized k parameters, the decoder 9 delivers decoded k parameters $k'_i$ (i=1, 2, . . . , P) to the multipulse waveform synthesizer 11. Decoding the quantized datum of the multipulses, the decoder 10 sends decoded multipulses to the multipulse waveform synthesizer 11.

The multipulse waveform synthesizer 11 waveform synthesizes for supply to an output terminal 15 the decoded k parameters $k'_i$ and the decoded multipulses by a clock signal of 8 kHz supplied through still another input terminal 13 into a synthesized speech signal.

In the conventional multipulse processing method described in the foregoing, the multipulses are extracted in whichever of the A-b-S method, a method of correlation processing, and use of the similarity measure.

Figure 2:
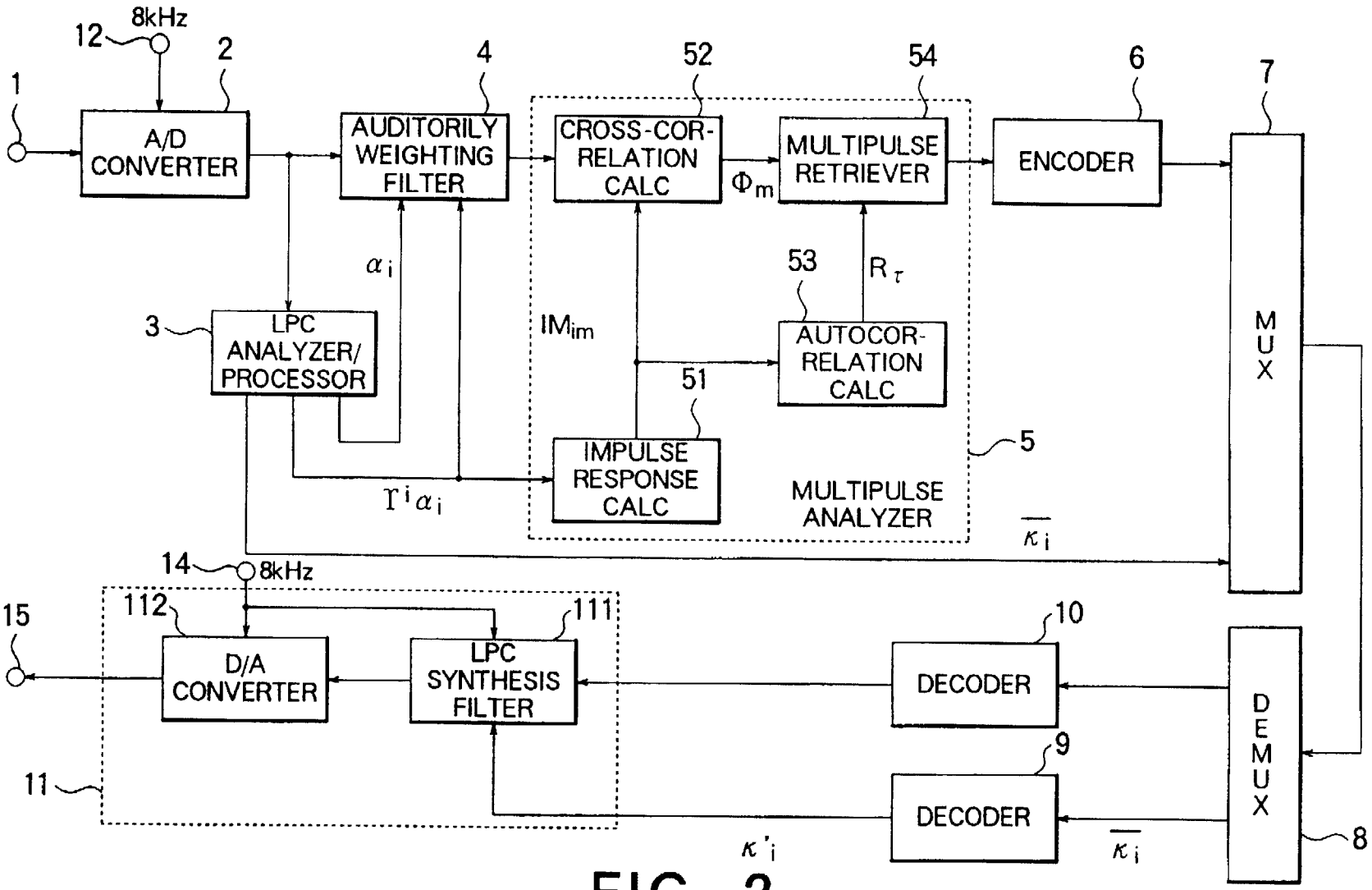
FIG. 2 PRIOR ART
FIG. 2 is a block diagram of a multipulse processing device for carrying out another conventional method wherein use is made of correlatiohn processing.

Turning to FIG. 2, another conventional multipulse processing method will briefly be described by resorting to the correlation processing. In the figure, similar parts are designated by like reference numerals as in FIG. 1 with their description omitted. In FIG. 2, the multipulse analyzer 5 comprises an impulse response calculator 51, a cross-correlation calculator 52, an autocorrelation calculator 53, and a multipulse retriever 54. The multipulse waveform synthesizer 11 comprises an LPC synthesis filter 111 and a D/A converter 112.

Supplied from the LPC analyzer/processor 3 with the attenuation α parameters $\gamma^i\alpha_i$, the impulse response calculator 51 calculates for delivery to the cross-correlation calculator 52 and the autocorrelation calculator 53 impulse responses $IM_{im}$ (im=0, 1, . . . ) of a filter of a transfer function H'(Z) given by Equation (2) as follows:

$$H'(Z)=1/\left(1-\sum_{i=1}^{P}\gamma^i\alpha_i Z^{-1}\right). \quad (2)$$

For supply to the multipulse retriever 54, the cross-correlation calculator 52 calculates cress-correlation coefficients $\phi_m$ (m=1, 2, . . . , M) of the sampled speech signal supplied from the auditorily weighting filter 4 and the impulse responses $IM_{im}$, where M represents a frame length of multipulse analysis. The cross-correlation coefficients represent a function indicative of correlation between two signal series.

For delivery to the multipulse retriever 54, the autocorrelation calculator 53 calculates autocorrelation coefficients $R_\tau$ (τ=−N, −N+1, . . . , −1, 0, 1, . . . , N) of the impulse responses $IM_{im}$ (where N represents a significant number of taps for autocorrelation calculation). The autocorrelation coefficients represent a function indicative of a degree of correlation between an original waveform signal and a shifted waveform signal into which the original waveform signal is shifted along a time axis.

Incidentally, the autocorrelation coefficients $R_\tau$ are symmetrical on plus and minus sides with a centre at a delay time of zero (namely, when the impulse responses $IM_{im}$ are coincident) and represent a waveform theoretically present from zero to plus infinity. In contrast to the impulse responses $IM_{im}$ of an idea of time (or time intervals), the autocorrelation coefficients $R_\tau$ represents another idea of tap delays (when represented by a discrete series). In practice, there are no problems even when the autocorrelation coefficients $R_\tau$ may be defined in a finite region, such as between minus several milliseconds and plus several milliseconds.

From the cross-correlation coefficients $\phi_m$ and the autocorrelation coefficients $R_\tau$, the multipulse retriever 54 retrieves multipulses according to the following procedures:

(1) Retrieve maxima of the cross-correlation coefficients $\phi_m$;

(2) At a position of a maximum of the maxima, defined is a pulse of an amplitude proportional to a value of the maximum;

(3) Correct the cross-correlation coefficients $\phi_m$ by the autocorrelation coefficients $R_\tau$ and the amplitude of the pulse; and (4) Repeat the above procedures (1) to (3) a predetermined number of times.

The multipulse waveform synthesizer 11 will next be described. Using, as filter coefficients, decoded k parameters $k'_i$ supplied from the decoder 9, the LPC synthesis filter 111 synthesizes sampled speech waveforms with an excitation source given by decoded multipulses delivered from the decoder 10. The sampled speech waveforms have a sampling frequency of 8 kHz defined by a clock signal supplied through the input terminal 14 with 8 kHz. Fed from the LPC synthesis filter 111, the sampled speech waveforms are delivered to the D/A converter 112 and digital to analogue converted into a continuous analogue speech signal for supply to the output terminal 15.

In the foregoing, the filter coefficients of the LPC synthesis filter 111 are given by the decoded k parameters $k'_i$ supplied from the decoder 9. It is possible instead to use the $\alpha$ parameters $\alpha_i$ converted therefrom.

In the conventional multipulse processing method described above, the freedom given to positions of the multipulses is confined by sampling instants at which the speech signal is sampled on the analyzing side. This reduces the efficiency of encoding of sampling on the analyzing side. As a countermeasure for obviating the confinement imposed in phase on analysis frames here and there in the analyzing side, it is possible to sample the speech signal at a higher sampling frequency largely higher than the Nyquist rate as described in the preamble of the instant specification.

Figure 3:
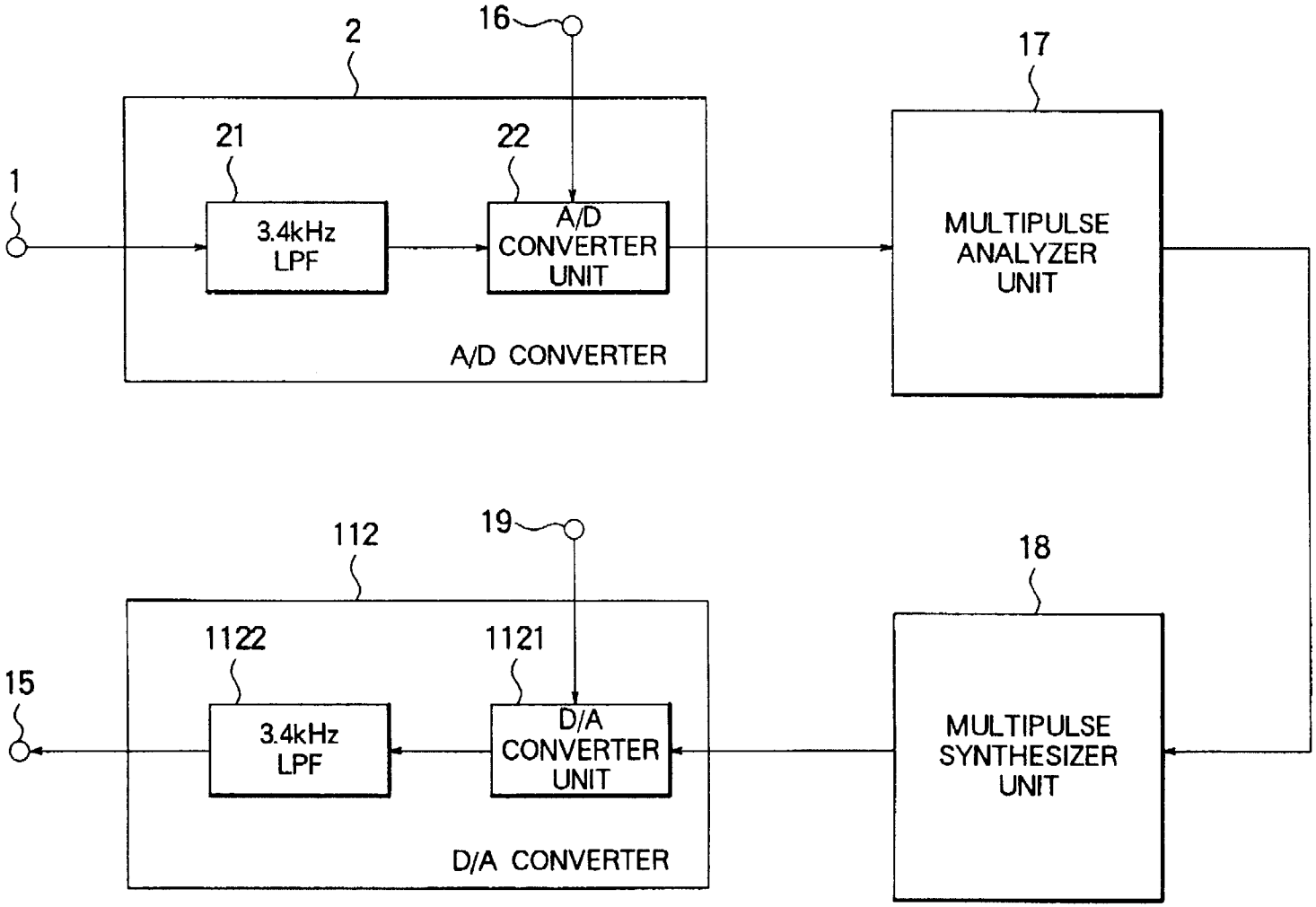
FIG. 3 PRIOR ART
FIG. 3 is a block diagram of a multipulse processing device for carrying out a different conventional method in which a sampling frequency is far higher than the Nyquist rate.

Turning to FIG. 3, description will proceed to a different multipulse processing method wherein use is made of a sampling frequency that is far higher than the Nyquist rate. In this figure, a speech signal is supplied through the input terminal 1 to the A/D converter 2. A built-in LPF 21 imposes an upper limit frequency of 3.4 kHz to a low-frequency component, which is delivered to an A/D converter unit 22 and is sampled by a high-rate sampling frequency supplied through an input terminal 16. This sampling frequency is far higher than the Nyquist rate, as 24 kHz.

Sampled in this manner by the A/D converter 2, the sampled speech signal is fed to a multipulse analyzer unit 17. Besides the LPC analyzer/processor 3 described in conjunction with FIG. 2, the multipulse analyzer unit 17 comprises the auditorily weighting filter 4, the multipulse analyzer 5, the encoder 6, and the multiplexer 7 and analyzes as above the sampled speech signal to extract and produces the LPC coefficients as the spectrum envelope information and multipulses as the excitation source information. Such information is sent through the transmission channel to a multipulse synthesizer unit 18.

Comprising the demultiplexer 8, the decoders 9 and 10, and the LPC synthesis filter 111 described in connection with FIG. 2, the multipulse synthesizer unit 18 synthesizes for supply to the D/A converter 112 the input information into a speech waveform sampled at 24 kHz. In the D/A converter 112, a built-in D/A converter unit 1121 digital to analogue converts the sampled speech signal delivered from the multipulse synthesizer unit 18 by a clock signal supplied through an input terminal 19 with 24 kHz. A continuous speech waveform is thereby obtained and converted by an LPF 1122 for removing folded components therefrom into a continuous speech signal below 3.4 kHz for delivery to the output terminal 15.

It is possible under the circumstances to raise the freedom given to the positions of multipulses. It is, however, indispensable to raise an order (the number) of the LPC filter coefficients provided that a prediction interval of the speech signal is kept unchanged. In this instance, forty-eight coefficients are necessary. As described in the preamble of the instant specification, this reduces the efficiency of encoding of the spectrum envelope information despite widening of the freedom given to the positions of multipulses by sampling as above the speech signal at the sampling frequency which is far higher than the Nyquist rate.

Figure 4:
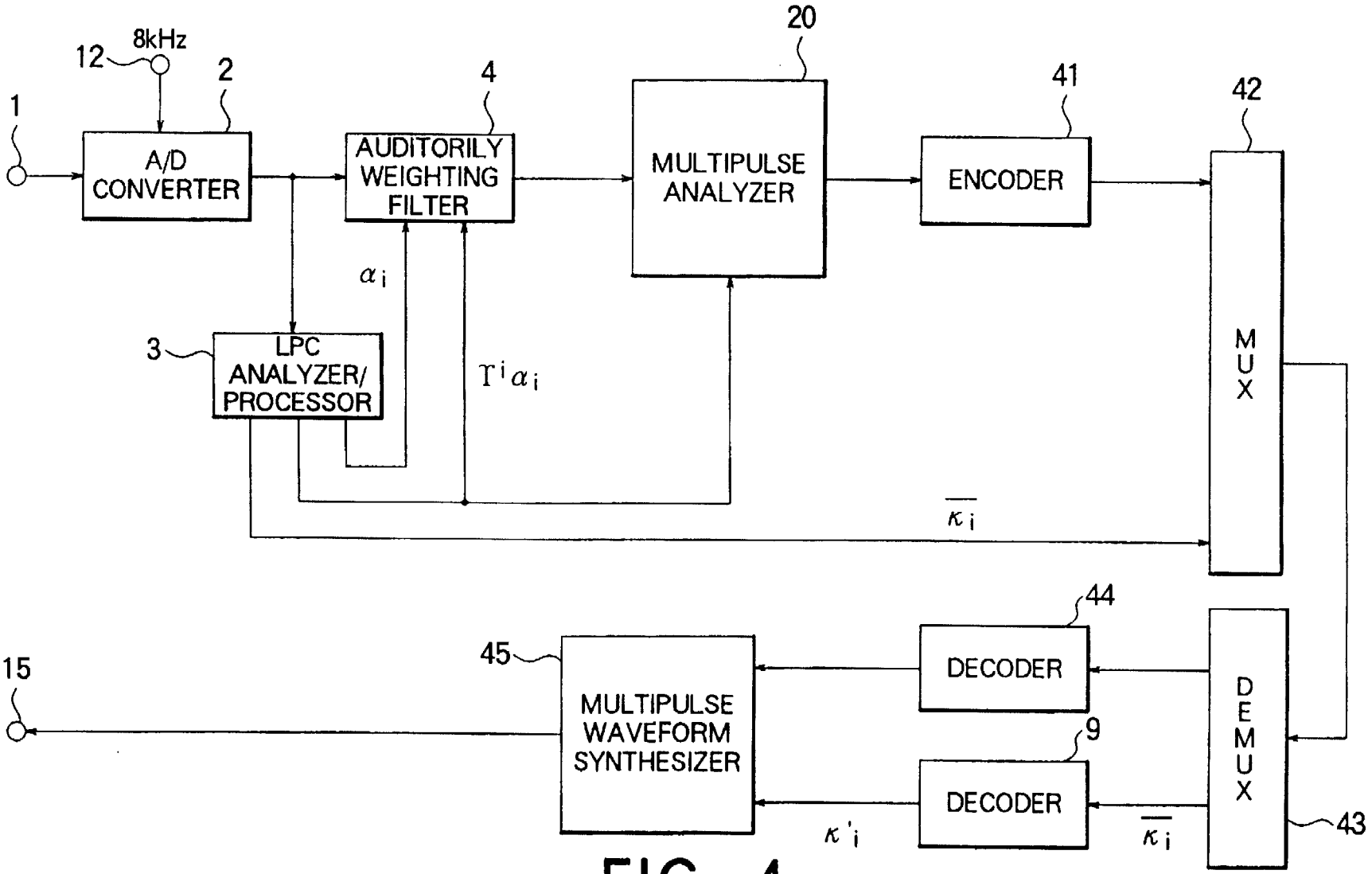
FIG. 4 is a block diagram of a multipulse processing device for carrying out a multipulse processing method according to a general embodiment of the instant invention.

Turning to FIG. 4, description will proceed to a multipulse processing method according to a general embodiment of this invention. In the figure, similar parts are designated by like reference numerals as in FIG. 1 with their description omitted. In FIG. 4, a multipulse analyzer 20 carries out multipulse analysis by deciding, with a higher degree of freedom used relative to sampling instants of a sampled speech signal delivered from the auditorily weighting filter 4, appearance time instants of impulses of a sequence which is produced by using the attenuation $\alpha$ parameters supplied thereto as an example of the LPC coefficients from the LPC analyzer/processor 3. A resulting sequence of multipulses is delivered to an encoder 41.

The encoder 41 quantizes pulse amplitudes and positions of the multipulse sequence. As for quantization of the amplitudes, the encoder 41 is similarly operable like the encoder 6 described in connection with the prior art of FIG. 1. As for quantization of the positions, a quantization bit number is decided in consideration of a raised precision of analysis and a quantization efficiency. The encoder 41 delivers quantized data to the multiplexer 42. The multiplexer 42 multiplexes the quantized data and the quantized k parameters supplied from the LPC analyzer/processor 3 as an example of the LPC coefficients, for delivery through the transmission channel to a synthesizing side.

A demultiplexer 43 demultiplexes multiplexed data supplied thereto through the transmission channel as the quantized data and the quantized k parameters. The quantized k parameters are delivered to the decoder 9. The quantized data are fed to another decoder 44. Decoding the quantized data of multipulses, the decoder 44 delivers a decoded sequence of multipulses to a multipulse waveform synthesizer 45.

Waveform synthesizing decoded k parameters $k'_i$ supplied from the decoder 9 and the decoded sequence of multipulses supplied from the decoder 44, the multipulse waveform synthesizer 45 delivers a speech signal to the output terminal 15. In as much as multipulses of the decoded sequence have positions given the degree of freedom relative to the sampling instants of the sampling frequency, the multipulse waveform synthesizer 45 deals with synthesis of the speech waveform in consideration of the degree of freedom.

Figure 5:
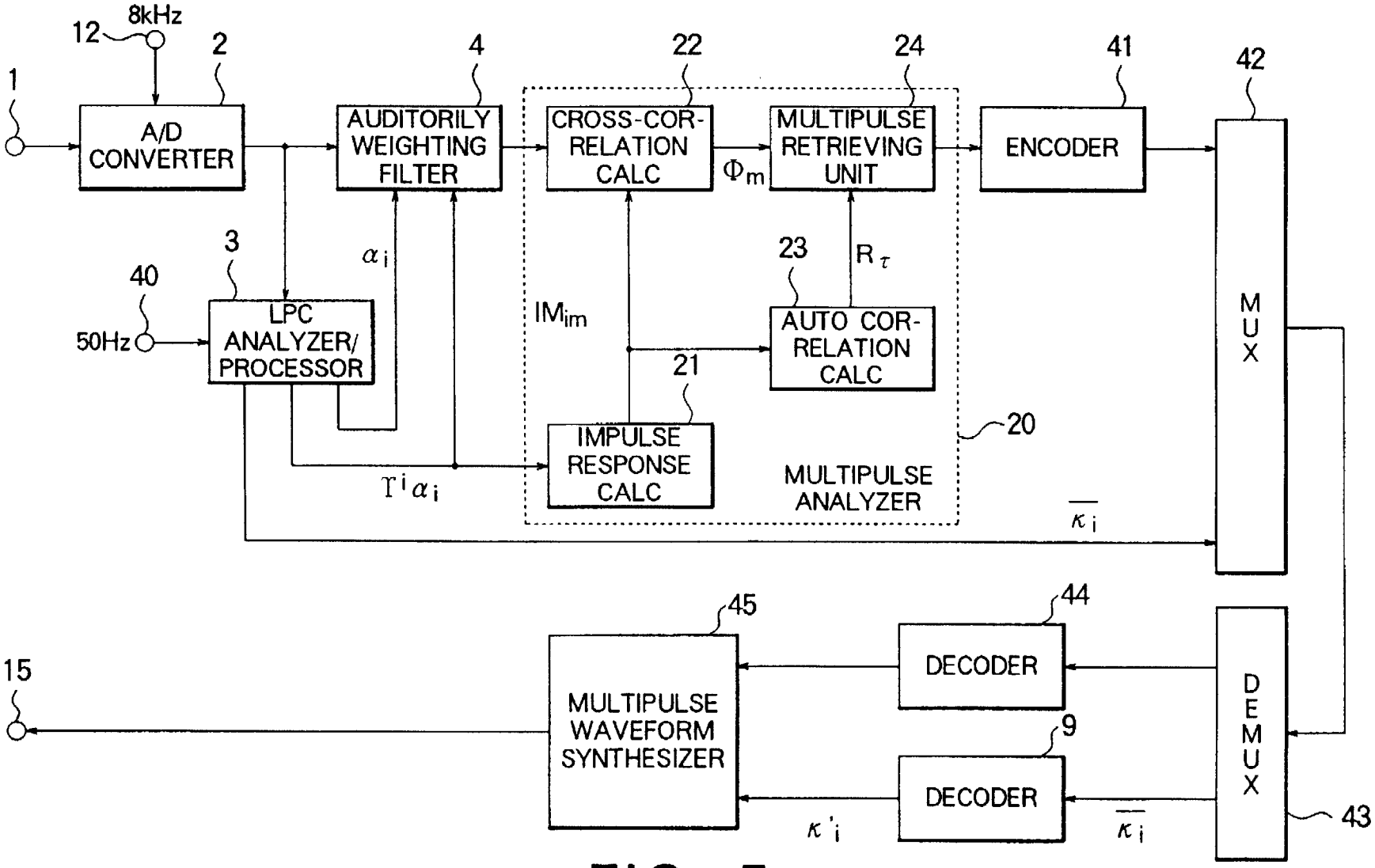
FIG. 5 is a block diagram of a multipulse processing device for carrying out a multipulse processing method according to a first embodiment of this invention.

Turning to FIG. 5, description will proceed to a first embodiment of this invention. In this figure, similar parts are designated by like reference numerals as in FIGS. 1 and 4 with their description omitted. In FIG. 5, an analyzing side comprises the A/D converter 2, the LPC analyzer/processor 3, the auditorily weighting filter 4, the multipulse analyzer 20, the encoder 41, and the multiplexer 42. A synthesizer side comprises the demultiplexer 43, the decoder 9, the decoder 44, and the multipulse waveform synthesizer 45.

This embodiment is characterised by structure of the multipulse analyzer 20 which will be described in greater detail besides the structure of the LPC analyzer/processor 3.

Figure 6:
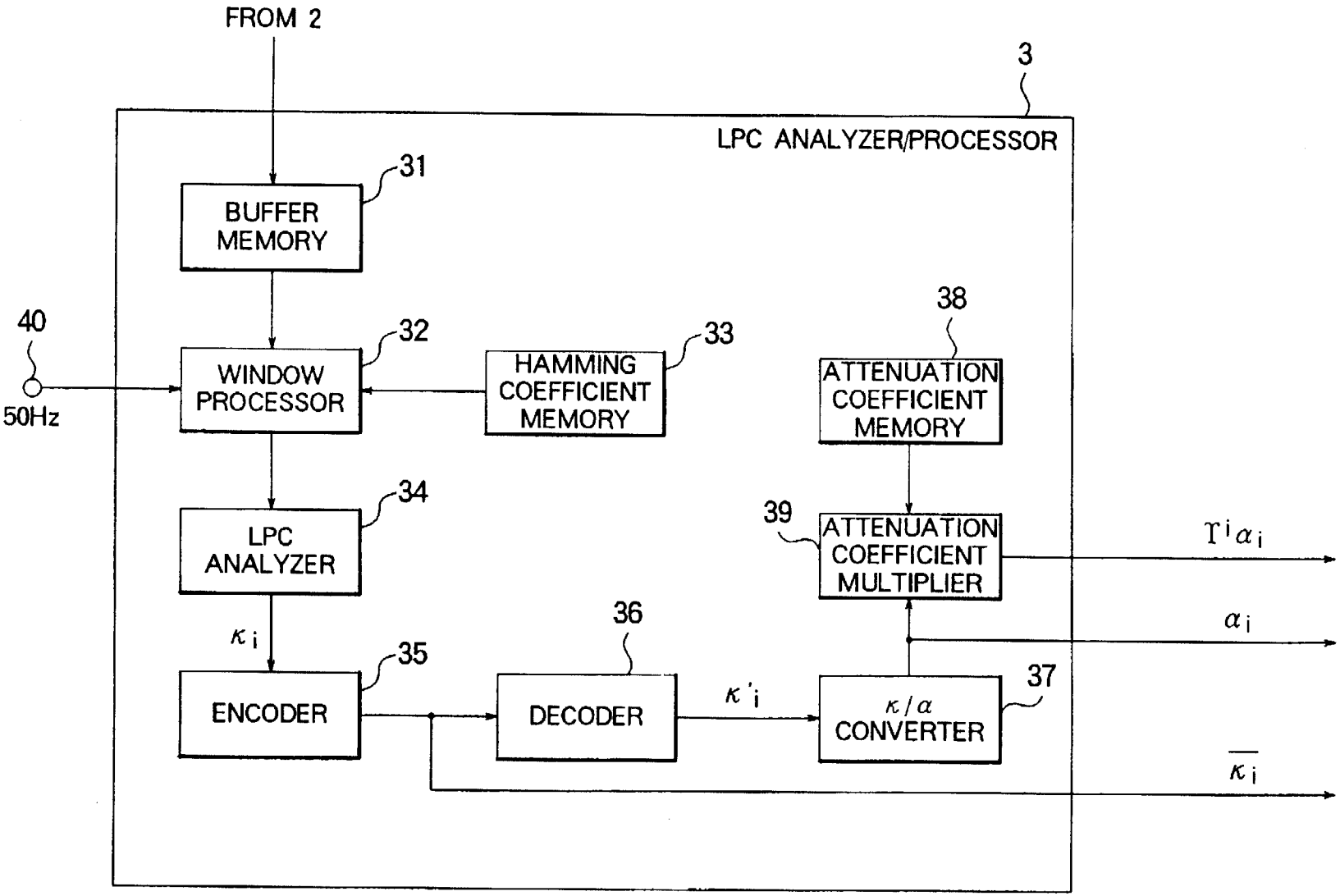
FIG. 6 is a block diagram of an LPC analyzer/processor used in the multipulse processing device of FIG. 5.

Referring to FIG. 6 exemplifying the LPC analyzer/processor 3 as a block diagram, the structure of the LPC analyzer/processor 3 will first be described. The LPC analyzer/processor 3 comprises a buffer memory 31, a window processor 32, a Hamming coefficient memory 33, an LPC analyzer 34, an encoder 35, a decoder 36, a k/α converter 37, an attenuation coefficient memory 39, and an attenuation coefficient multiplexer 39. The decoder 36 is equivalent in structure with the decoder 9 used as the synthesizing side.

In operation of the LPC analyzer/processor 3, the sampled speech signal is produced by the A/D converter 2 and is temporarily stored in the buffer memory 31. From the buffer memory 31, the sampled speech signal of 30 ms (240 samples) is read in each frame of 20 ms by the window processor 32 supplied with a frame signal of 50 Hz from an input terminal 40 and is window processed by Hamming coefficients (240 points) read from the Hamming coefficient memory 33. A result of processing is delivered to the LPC analyzer 34.

Using the sampled speech signal which is window processed, the LPC analyzer 34 calculates the k parameters $k_i$ (i=1, 2, . . . , P) as an example of the LPC coefficients. In the example being illustrated, P is equal to twelve. Calculated, the k parameters $k_i$ are quantized by the encoder 35 into the quantized k parameters $\overline{k_i}$ (i=1, 2, . . . , P), which are delivered outwardly and are supplied to the decoder 36 to be decoded.

Produced by the decoder 36, decoded k parameters $k'_i$ (i=1, 2, . . . , P) are converted by the k/α converter 37 in the known manner into the α parameters $\alpha_i$ (i=1, 2, . . . , P) which are delivered outwardly and are supplied to the attenuation coefficient multiplier 39. The attenuation coefficient multiplier 39 multiplies the α parameters $\alpha_i$ and attenuation coefficients $\gamma^i$ read from the attenuation coefficient memory 38. Results of multiplication are produced outwardly as the attenuation α parameters $\gamma_i\alpha^i$ (i=1, 2, . . . , P).

Referring back to FIG. 5, the multipulse analyzer 20 comprises an impulse response calculator 21, a cross-correlation calculator 22, an autocorrelation calculator 23, and a multipulse retriever 24. Among element blocks of the multipulse analyzer 20, the impulse response calculator 21, the cross-correlation calculator 22, and the autocorrelation calculator 23 are similar in structure and operation to the impulse response calculator 51, the cross-correlation calculator 52, and the autocorrelation calculator 53 described before. Being different from the above-described multipulse retriever 54, the multipulse retriever 24 has a structure depicted in FIG. 7.

Figure 7:
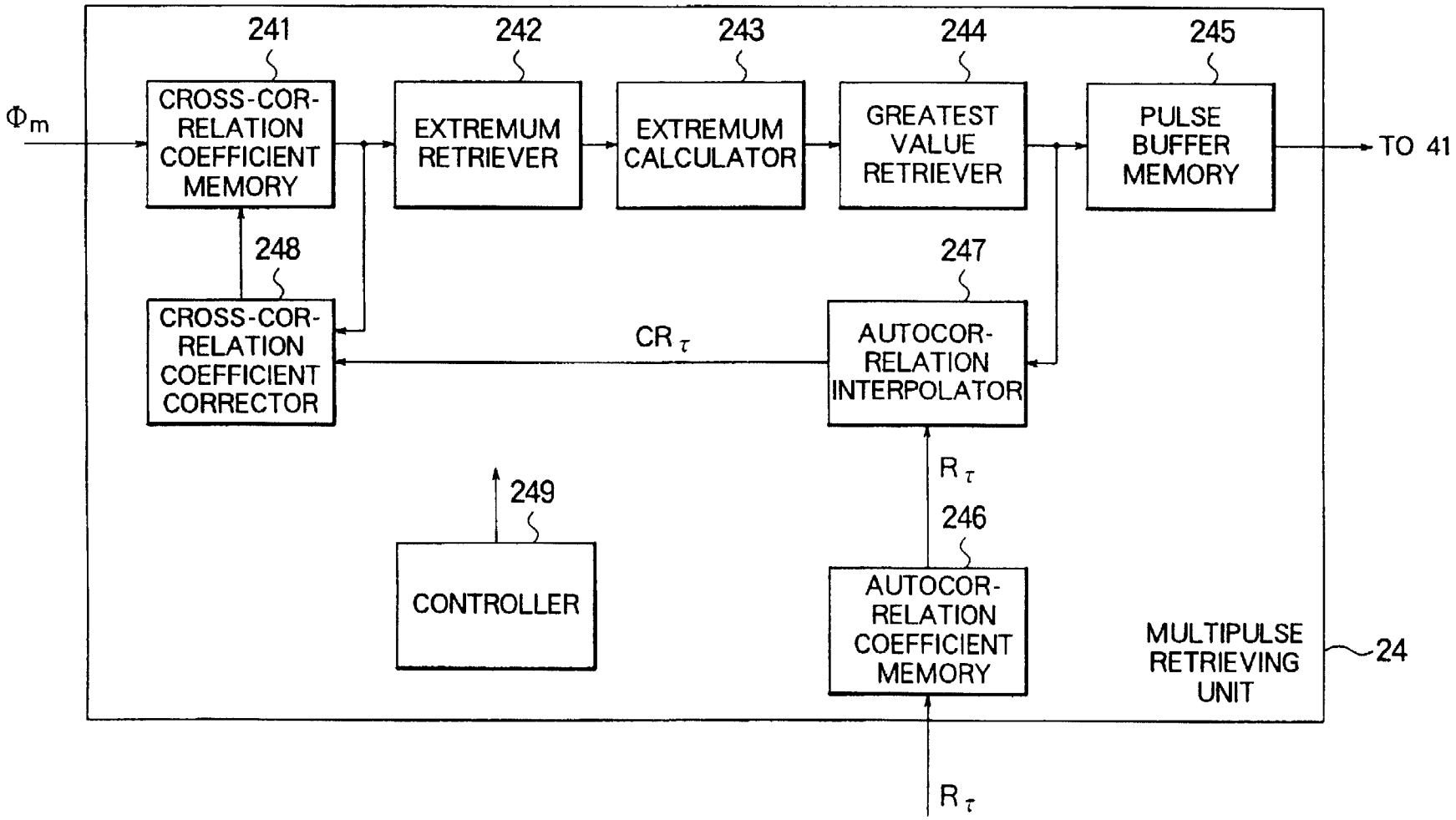
FIG. 7 is a block diagram of a multipulse retrieving unit used in the multipulse processing device of FIG. 5.

Referring to FIG. 7, the multipulse retriever 24 comprises a cross-correlation coefficient memory 241, an extremum retriever 242, an extremum calculator 243, a greatest value retriever 244, a pulse buffer memory 245, an autocorrelation coefficient memory 246, an autocorrelation interpolator 247, a cross-correlation coefficient corrector 248, and a controller 249.

Calculated by the cross-correlation calculator 22 of FIG. 5, the cross-correlation coefficients $\phi_m$ (m=1, 2, . . . , M) are stored in the cross-correlation coefficient memory 241, where M represents a multipulse analysis frame length and corresponds to 20 ms or 160 samples of 8-kHz samples in the example being illustrated. Calculated by the autocorrelation calculator 23 of FIG. 5, the autocorrelation coefficients $R_\tau$ (τ=−N, −N+1, . . . , −1, 0, 1, . . . , N) are stored in the autocorrelation coefficient memory 246, where N represents a significant number of taps for autocorrelation calculation and corresponds to 2.5 ms or twenty 8-kHz samples in the illustrated example.

Stored in the cross-correlation coefficient memory 241, the cross-correlation coefficients $\phi_m$ are read for delivery to the extremum retriever 242 and the cross-correlation coefficient corrector 248. The extremum retriever 242 retrieves all maxima and minima (the maxima with minus signs) of the cross-correlation coefficients $\phi_m$ delivered thereto and supplies the extremum calculator 243 with data of three consecutive samples consisting of each extremum and two samples preceding and following the extremum. Using these three samples, the extremum calculator 243 calculates positions and amplitudes of such extrema by quadrature interpolation in accordance with Equations (3) and (4) as follows:

$$t_{of}(L)=(1/2)(\phi_{L-1}-\phi_{L+1})/(\phi_{L-1}-2\phi_L+\phi_{L+1}), \quad (3)$$

$$\phi_P(L)=t_{of}(L)^2(\phi_{L-1}-2\phi_L+\phi_{L+1})/2+t_{of}(L)(\phi_L-\phi_{L-1})/2+\phi_L, \quad (4)$$

where in both equations $\phi_L$, $\phi_{L-1}$, and $\phi_{L+1}$ represent the cross-correlation coefficients at one of the maxima or the minima and the preceding and the following ones of the cross-correlation coefficients $\phi_m$ and L represents a sample number of an extremum, namely, the maximum or the minimum, L being equal to or greater than 1 and equal to or less than M. Furthermore, $t_{of}(L)$ represents an offset from a sample where one of discrete extrema is present, $t_{of}$ having continuous values between minus 1 and plus 1, both exclusive. When $t_{of}(L)$ is negative and positive, the extremum is present between samples L and L−1 and is present between samples L and L+1. In addition, $\phi_P(L)$ represents an extremum value. The extremum calculator 243 supplies the greatest value retriever 244 with the. positions and the amplitudes calculated in this manner for ail extrema corresponding to all maxima and minima.

From the positions and the amplitudes delivered for all extrema, the greatest value retriever 244 retrieves a greatest absolute value of the amplitudes to store in the pulse buffer memory 245 and to deliver to the autocorrelation interpolator 247 its amplitude value $\phi_P(L_1)$, its sample number $L_1$, and its offset $t_{of}(L_1)$.

Using the greatest amplitude value $\phi_P(L_1)$ of the extrema, the sample number $L_1$, the offset $t_{of}(L_1)$ supplied from the greatest value retriever 244, and the autocorrelation coefficients $R_\tau$ read from the autocorrelation coefficient memory 246, the autocorrelation interpolator 247 calculates interpolated autocorrelation coefficients $CR_\tau$ by the quadrature interpolation of Equations (5) and (6) and delivers them to the cross-correlation coefficient corrector 248 together with the sample number $L_1$.

$$CR_\tau=(\phi_P(L_1)/R_0)CR'_\tau \quad (5)$$

$$CR'_\tau=(1/2)t_{of}(L_1)^2(R_{\tau-1}-2R_\tau+R_{\tau+1})-(1/2)t_{of}(L_1)(R_{\tau-1}+2R_\tau-R_{\tau+1})+R_0, \quad (6)$$

for $\tau=-N+1, -N+2, \ldots, N-2, N-1$.

Using the interpolated autocorrelation coefficients $CR_\tau$ and the sample number $L_1$ supplied from the autocorrelation interpolator 247, the cross-correlation coefficient corrector 248 corrects the cross-correlation coefficients $\phi_m$ delivered thereto from the cross-correlation coefficient memory 241 according to the following equation. Results of correction are stored back in the cross-correlation coefficient memory 241.

$$\phi_{L1+j}=\phi_{L1+j}-CR_j, \quad (7)$$

for $j=-N+1, -N+2, \ldots, N-2, N-1$.

In this equation, correction is not carried out when $L_1+j$ is either greater than zero or greater than M+1 to show outside of the window processing.

Subsequently using the cross-correlation coefficients $\phi_m$ subjected to correction, the pulse buffer memory 245 is supplied and loaded with, among similarly obtained positions and amplitudes of all extrema, an amplitude value $\phi_P(L_2)$ of a second greatest absolute amplitude, its sample number $L_2$, and its offset $t_{of}(L_2)$. Likewise, the pulse buffer memory 245 is loaded with amplitudes, sample numbers, and offsets of pulses having a third, a fourth, and others of the absolute amplitudes.

Controlling whole operation of the multipulse retriever 24, the Controller 249 continues retrieval and storage in the pulse buffer memory 245 of pulses until the pulse buffer memory 245 is loaded with information of the pulses of a predetermined number. After the information is stored up to the pulses of the predetermined number, multipulse information is read out of the pulse buffer memory 245 and is outwardly delivered.

Referring back to FIG. 5, the encoder 41 quantizes in the manner used in the encoder 6 the multipulse information $\phi_P(L_1)$, $\phi_P(L_2)$, and others among the multipulse information produced by the multipulse retriever 24 of the multipulse analyzer, namely, the amplitude information $\phi_P(L_1)$, $\phi_P(L_2)$, and so forth, the sample numbers L(1), L(2), and so on, and the offsets $t_{of}(L_1)$, $t_{of}(L_2)$, and others of the extrema selected up to the predetermined number from all extrema of the cross-correlation coefficients $\phi_m$.

In the manner which is basically identical with that used in the encoder 6, the encoder 41 quantizes position information $L_1$, $t_{of}(L_1)$, $L_2$, $t_{of}(L_2)$, and so forth of multipulses. It is, however, necessary to use a slightly increased quantization bit number. This is because the continuous values $t_{of}(L_1)$, $t_{of}(L_2)$, and so on are included in the example being illustrated in contrast to position information of discrete values processed by the encoder 6. In the illustrated example, two additional bits are used for quantization of the continuous values. This increase in the bit number somewhat adversely affects very great raise of efficiency of multipulse retrieval. The effect is, however, little.

On the analyzing side, the quadrature interpolation is used on retrieval of multipulses by the multipulse retriever 24. It is possible instead to use interpolation of third or higher degrees or to use linear summation of interpolated values of frequency components obtained by Fourier expansion.

Referring to FIG. 5, the synthesizing side will now be described. The multipulse waveform synthesizer 45 is implemented in various manners.

Figure 8:
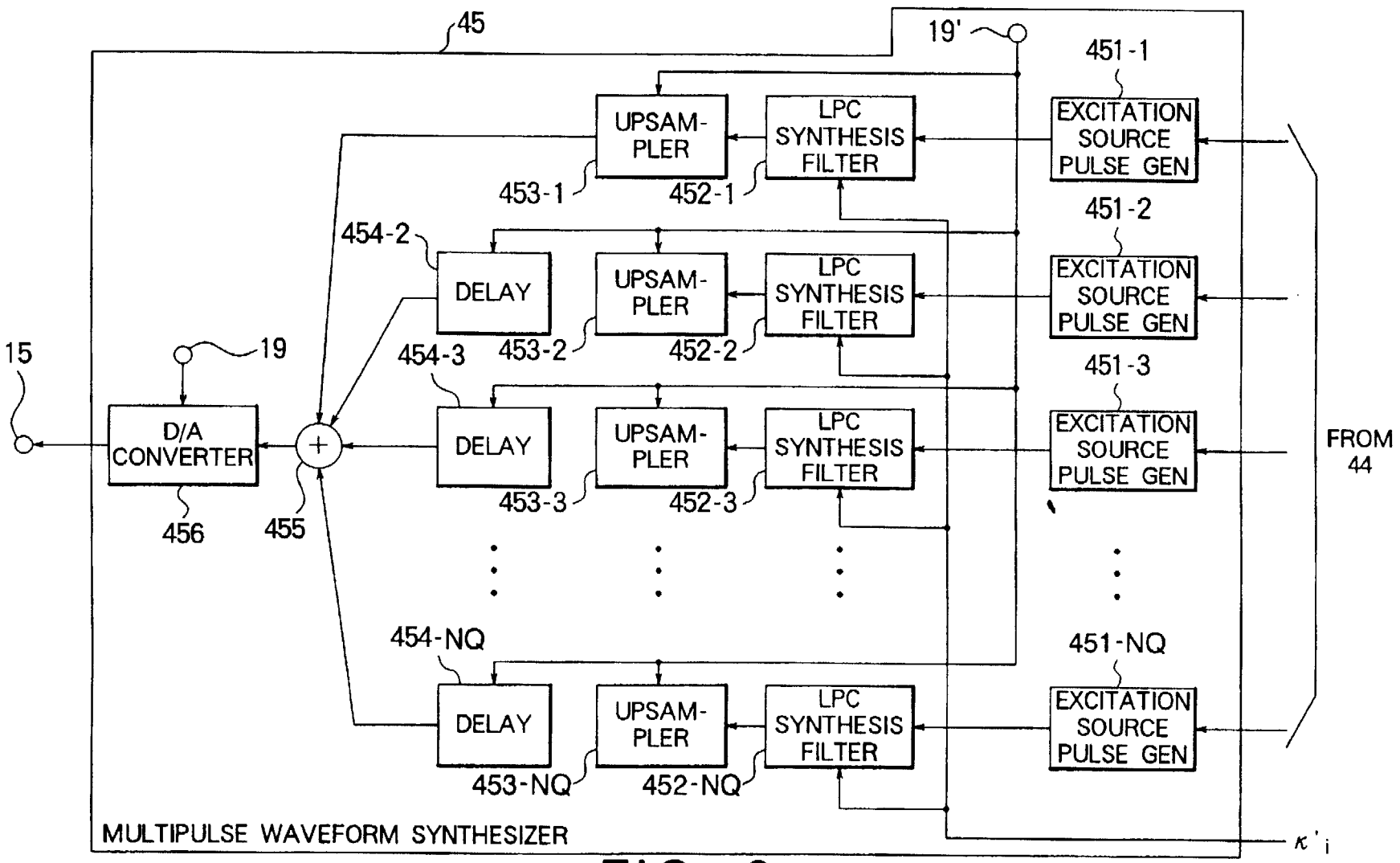
FIG. 8 is a block diagram of a first example of a multipulse waveform synthesizer used in the multipulse processing device of FIG. 5.

Turning to FIG. 8, a first example of the multipulse waveform synthesizer 45 is used in the synthesizing side. In this example, the multipulse waveform synthesizer 45 comprises excitation source pulse generators 451-1 to 451-NQ, LPC synthesis filters 452-1 to 452-NQ, upsamplers 453-1 to 453-NQ, delay circuits 454-2 to 454-NQ, an adder 455, and a D/A converter 456.

Figure 17:
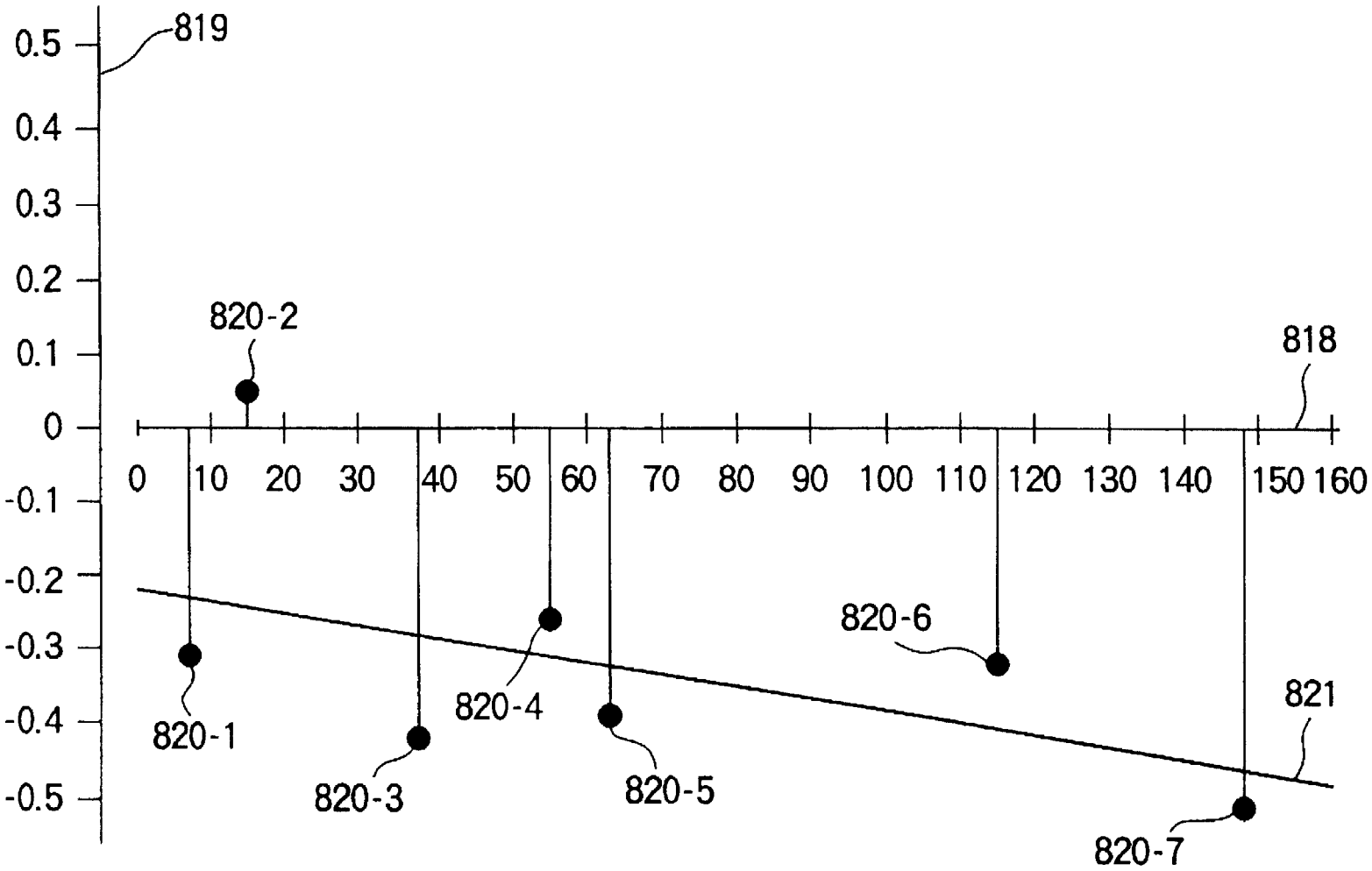
FIG. 17 is a representation of how to decide a mapping function of FIG. 16.
Figure 18:
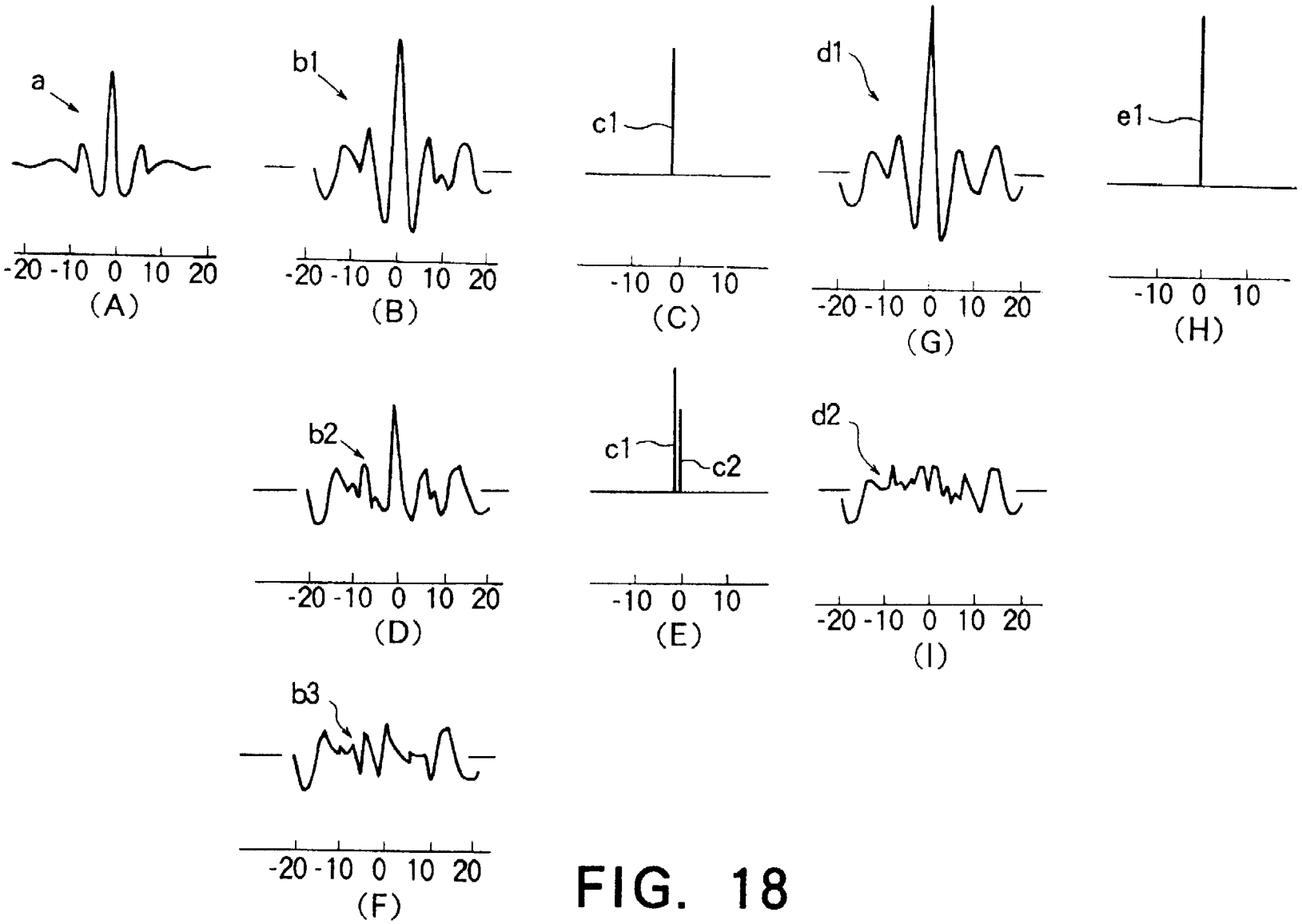
FIG. 18 is a diagram for use in describing a difference of a method according to this invention from a conventional method.

Each of the LPC synthesis filters 452-1 to 452-NQ is similar in structure to the LPC synthesis filter 111 of prior art of FIG. 17 (in FIG. 8, the input of 8-kHz clock signal being omitted). Like the D/A converter 112 described in conjunction with FIG. 18, the D/A converter 456 is supplied with the high-rate clock signal through an input terminal 19. This clock signal is supplied also to the upsamplers 453-1 to 453-NQ through an input terminal 19'.

In operation, the LPC synthesis filters 452-1 to 452-NQ of FIG. 8 are supplied as filter coefficients with the decoded k parameters $k'_i$ (i=1, 2, . . . , P) from the decoder 9 depicted in FIG. 5. The excitation source pulse generators 451-1 to 451-NQ of FIG. 8 are supplied with the decoded multipulse information from the decoder 44 illustrated in FIG. 5. Here, NQ represents an integer which is decided by the quantization bits assigned in the encoder 41 of the analyzing side to the continuous values $t_{of}(L_1)$, $t_{of}(L_2)$, and others and is equal to two to the power of the quantization bits. That is, NQ is equal to 4 ($=2^2$).

During quantization and decoding, the positions of multipulses are discretely represented. This discrete representation is implemented by dividing each sampling period by NQ for the input speech signal. As a consequence, the excitation source pulse generator 451-1 is supplied and the multipulse information coincident in time with each sampling point used on the analyzing side. The excitation source pulse generator 451-2 is supplied with the multipulse information which has a delay of 125/NQ (microseconds) relative to each sampling point used on the analyzing side. In this manner, the excitation source pulse generator 451-NQ is supplied with the multipulse information delayed by 125 (NQ−1)/NQ (microseconds) from each sampling point used on the analyzing side.

In synchronism with the multipulse information, the excitation source pulse generators 451-1 to 451-NQ generate excitation source pulses for supply to the LPC synthesis filters 452-1 to 452-NQ. Using the decoded k parameters $k'_i$ in common as filter coefficients, the LPC synthesis filters 452-1 to 452-NQ individually synthesize the excitation source pulses to deliver synthesized waveforms to the upsamplers 453-1 to 453-NQ, respectively.

The upsamplers 453-1 to 453-NQ upsample at NQ times the waveforms (8-kHz sampled) supplied thereto. NQ being equal to four, results are discrete waveforms sampled at 32 kHz. This upsampling is carried out in the known manner by each LPF which is operable at 32 kHz and is supplied with waveform samples of 8-kHz periods and with zeros during other 24-kHz periods. An output signal of the upsampler 453-1 is delivered directly to the adder 455. Output signals of the upsamplers 453-1 to 453-NQ are delivered to the adder 455 with predetermined delays given by the delay circuits 454-2 to 454-NQ, respectively.

The delay circuit 454-2 gives a delay of one clock period or 125/NQ (microseconds) to a 32-kHz sampled discrete waveform. The delay circuit 454-3 gives a delay of two clock periods (that is, 250/NQ microseconds) to another 32-kHz sampled discrete waveform. In this manner, the delay circuit 454-NQ gives a delay of (NQ−1) clock periods, or 125(NQ−1)/NQ (microseconds) to a 32-kHz sampled waveform.

For delivery to the D/A converter 456, the adder 455 sums up NQ 32-kHz sampled waveform trains, sample by sample. Using a 32-kHz clock signal supplied through the input terminal 19, the D/A converter 456 digital to analogue converts an output 32-kHz sampled sequence of the adder 455 into an analogue speech signal for supply to the output terminal 15.

Figure 9:
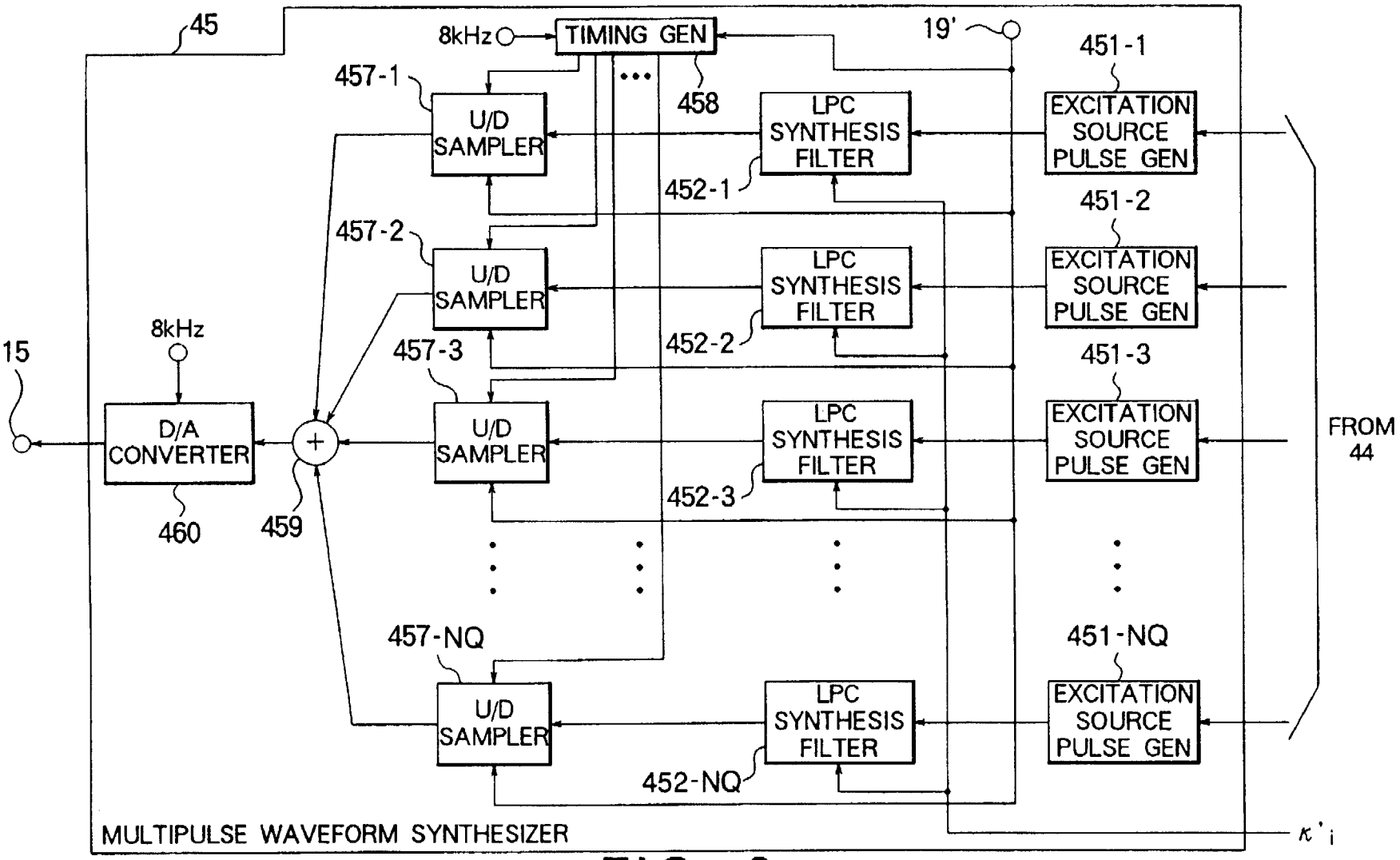
FIG. 9 is a block diagram of a second example of the multipulse waveform synthesizer used in the multipulse processing device of FIG. 5.

Referring to FIG. 9, the description will proceed to a second example of the multipulse waveform synthesizer 45. A block diagram of the second example is depicted. In this figure, similar parts are designated by like reference numerals as in FIG. 8 with their description omitted. In FIG. 9, the upsamplers 453-1 to 453-NQ of the multipulse waveform synthesizer 45 of FIG. 8 are changed to up-down (U/D) samplers 457-1 to 457-NQ and a timing generator 458. Furthermore, use is made of a D/A converter 460 operable at the 8-kHz clock signal like the D/A converter of prior art (112 in FIG. 2).

Synthesized by the LPC synthesis filters 452-1 to 52-NQ, 8-kHz sampled waveforms are NQ-times upsampled individually by the U/D samplers 457-1 to 457-NQ and then downsampled to positions indicated by 8-kHz timing pulse sequences produced by the timing generator 458 and used separately.

More particularly, the U/D samplers 457-1 to 57-NQ convert the 8-kHz sampled waveforms into the waveforms sampled at an NQ-times sampling frequency by the use of known digital LPF's operable at a clock signal of the NQ-times frequency. Subsequently, the timing pulse sequences of the timing generator 458 are used to resample the waveforms sampled at the NQ-times sampling frequency. Furthermore, the synthesis reference clock signal is used in common for resampling into 8-kHz discrete waveform.

In the foregoing, the timing generator 458 produces 8-kHz timing pulse (clock) sequences having NQ phases, namely, NQ timing pulse sequences having a phase difference of 360/NQ degrees between each part. The U/D sampler 457-1 is supplied with one of the timing pulse sequences that is phase coincident with the 8-kHz clock signal used in driving the LPC synthesis filters 452-1 to 452-NQ. The U/D sampler 457-2 is supplied with the timing pulse sequence of a phase delay of 125/NQ (microseconds). In this manner, the U/D sampler 457-NQ is supplied with the timing pulse sequence of a phase delay of 125(NQ−1)/NQ (microseconds).

For supply to the D/A converter 460, the adder 459 sums up, sample by sample, the NQ discrete waveform sequences produced by the U/D samplers 457-1 to 457-NQ at 8 kHz and with a common phase. Based on the 8-kHz clock signal, the D/A converter 460 converts an input sum signal to an analogue signal for supply of a continuous speech signal to the output terminal 15.

Figure 10:
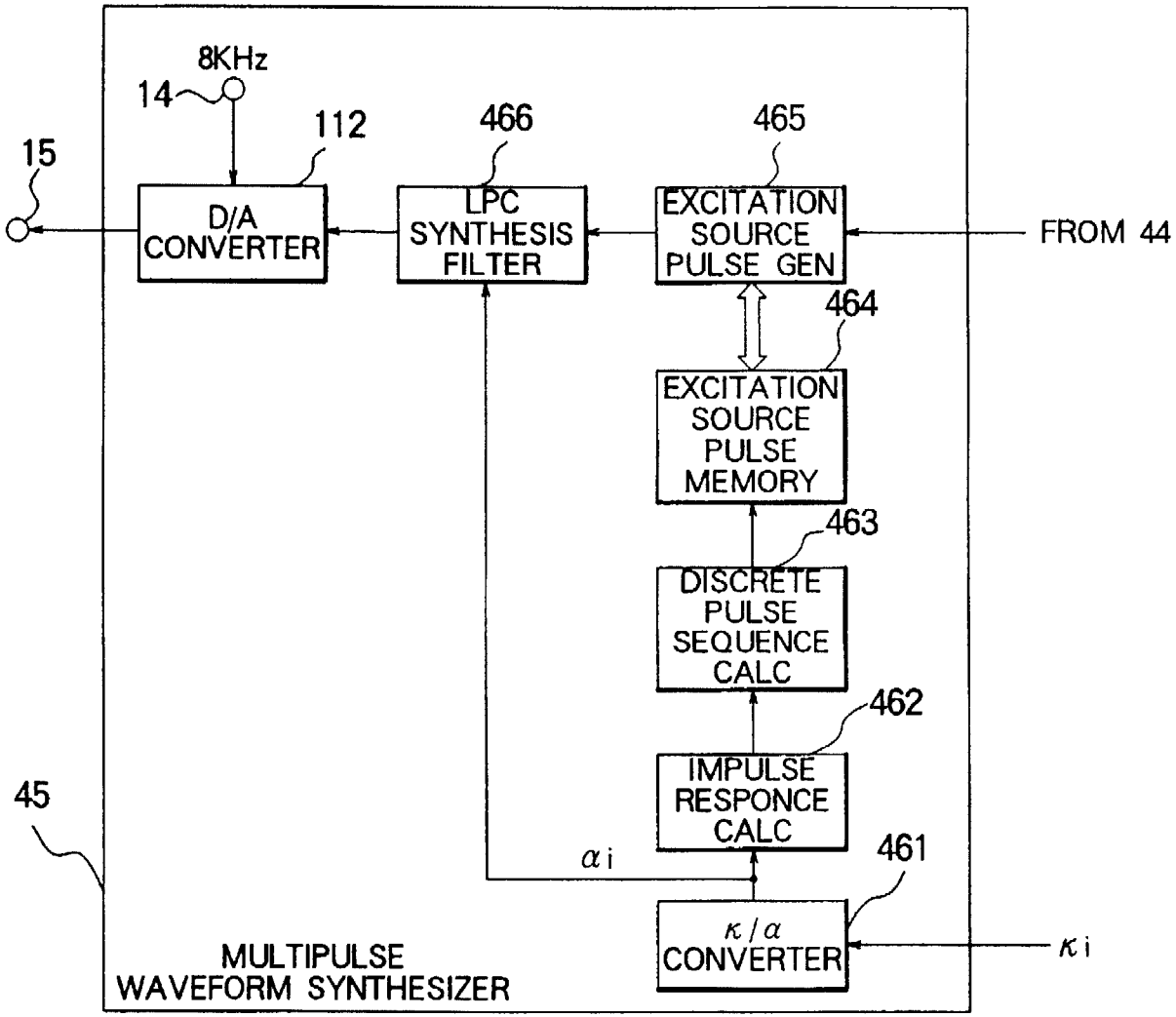
FIG. 10 is a block diagram of a third example of the multipulse waveform synthesizer used in the multipulse processing device of FIG. 5.

Referring to FIG. 10, a third example will be described of the multipulse waveform synthesizer 45. A block diagram of this example is illustrated. The multipulse waveform synthesizer 45 of this example comprises k/α converter 461, an impulse response calculator 462, a discrete pulse sequence calculator 463, an excitation source pulse memory 464, an excitation source pulse generator 465, an LPC synthesis filter 466, and a D/A converter 112.

Among these, the k/α converter 461 is similar in structure to the k/α converter 37 depicted in FIG. 6 and used in the LPC analyzer/processor 3 on the analyzing side. The D/A converter 112 is identical in structure with the D/A converter 112 illustrated in FIG. 2 for use in the multipulse waveform synthesizer 11 on the synthesizing side. The impulse response calculator 462 is similar in structure and operation to the impulse response calculator 21 depicted in FIG. 5 except for supply thereto of the α parameters $\alpha_i$ instead of the attenuation α parameters $\gamma^i\alpha_i$.

The LPC synthesis filter 466 uses the α parameters $\alpha_i$ as its filter coefficients. The LPC synthesis filter 466 may use the decoded k parameters $k'_i$ as its filter coefficient. In this event, the LPC synthesis filter 466 is coincident in structure with the LPC synthesis filter 111 of FIG. 2 or the LPC synthesis filter 452-1 or the like of FIG. 9.

In operation, the decoded k parameters $k'_i$ are delivered from the decoder 9 to the k/α converter 461 and are converted into the α parameters $\alpha_i$ and delivered to the LPC synthesis filter 466 as the filter coefficients and to the impulse response calculator 462. For a time interval sufficient in practice (12.5 ms or 100 samples in the illustrated example), the impulse response calculator 462 calculates impulse responses of a filter having the α parameters $\alpha_i$ as its filter coefficients for delivery to the discrete pulse sequence calculator 463.

The discrete pulse sequence calculates a sequence of pulses with pertinent amplitudes at a plurality of sampling points for use in exciting a filter which would produce a synthesized waveform identical with the waveform produced when excited at time instants other than the sampling point. The sequence of pulses is delivered to the excitation source pulse memory 464.

Figure 11:
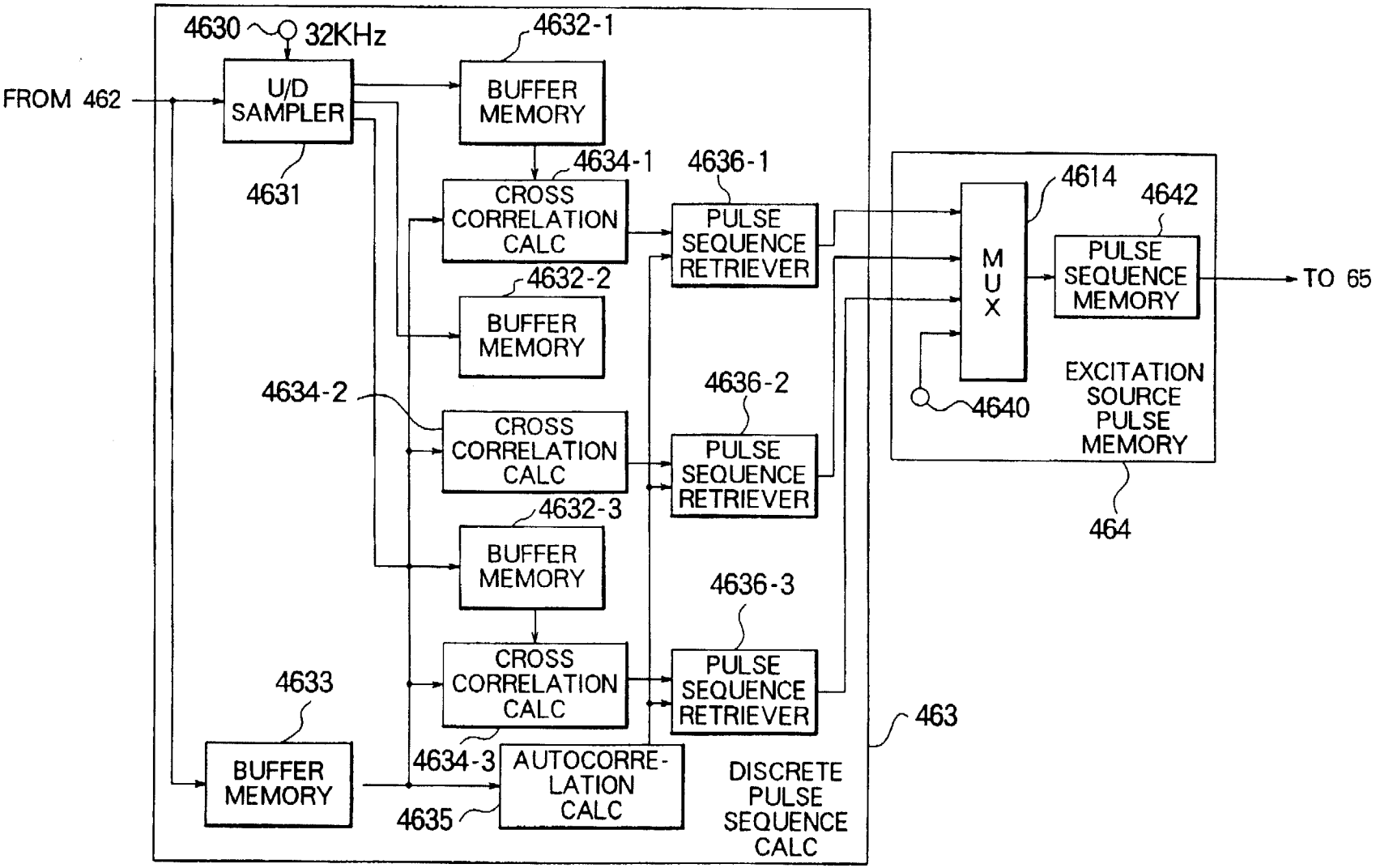
FIG. 11 is a block diagram of a combination of a discrete pulse sequence calculator and an excitation source pulse memory which combination is used in the multipulse waveform synthesizer of FIG. 10.

Turning to FIG. 11, structure and operation of the discrete pulse sequence calculator 463 and the excitation source pulse memory 464 will be described in detail. The discrete pulse sequence calculator 463 and the excitation source pulse memory 464 are depicted in blocks in FIG. 11. As illustrated in the figure, the discrete pulse sequence calculator 463 comprises an up-down (U/D) sampler 4631, buffer memories 4632-1 to 4632-3, a buffer memory 4633, cross-correlation calculators 4634-1 to 4634-3, an autocorrelation calculator 4635, and pulse sequence retrievers 4636-1 to 4636-3. The excitation source pulse memory 464 comprises a multiplexer 4641 and a pulse sequence memory 4642.

Being a digital LPF driven by a 32-kHz clock signal supplied through an input terminal 4630, the U/D sampler 4631 produces sampled waveforms into which delayed are the impulse responses (100 samples) of a 8-kHz sampled waveform supplied from the impulse response calculator 462 by ¼ of its sampling period, namely, by 31.25 microseconds.

For conversion of the 8-kHz sampled waveforms into 32-kHz sampled waveforms, the U/D sampler 4631 first inserts three zero points in each of 8-kHz sampling points. By filter calculation, waveforms are generated with structures similar in each repeat interval to the waveform of the impulse responses. Subsequently, the U/D sampler 4631 produces sequences of samples for storage in the buffer memories 4632-1, 4632-2, and 4632-3, respectively, at timings at which three zero points are inserted.

As a result, the buffer memory 4632-1 is loaded with the waveform sequence of sampling points which are delayed by 31.25 microseconds from the sampling points of 8 kHz. The buffer memory 4632-2 is loaded with the waveform sequence of sampling points delayed by 62.5 microseconds from the 8-kHz sampling points. The buffer memory 4632-3 is loaded with the waveform sequence of sampling points delayed by 93.75 microseconds from the 8-kHz sampling points. The buffer memory 4633 is loaded with the waveform sequence of sampling points coincident with the 8-kHz sampling points.

The discrete pulse sequence calculator 463 uses the procedure of multipulse retrieval by correlation processing of Ozawa et al mentioned heretobefore. This is in order to calculate and retrieve as a pulse sequence a linear combination representative of the waveform sequences stored in the buffer memories 4632-1 to 4632-3 by a linear combination of the waveform sequence stored in the buffer memory 4633.

From storages in the buffer memories 4632-1 to 4632-3, the waveform sequences are delivered to the cross-correlation calculators 4634-1 to 4634-3. From a storage in the buffer memory 4633, the waveform sequence is delivered to the cross-correlation calculators 4634-1 to 4634-3 and to the autocorrelation calculator 4635. The cross-correlation calculators 4634-1 to 4634-3 calculate cross-correlation coefficients for supply to corresponding ones of the pulse sequence retrievers 4636-1 to 4636-3. The autocorrelation calculator 4635 calculates autocorrelation coefficients for supply to each of the pulse sequence retrievers 4636-1 to 4636-3.

By using, in the procedure of multipulse retrieval according to correlation processing, the cross-correlation and the autocorrelation coefficients, the pulse sequence retrievers 4636-1 to 4636-3 retrieve pulse sequences, respectively, each being a sequence of coefficients sampled at 8 kHz. Retrieved, the pulse. sequences are delivered in the excitation source pulse memory 464 to the multiplexer 4641.

In addition to the pulse sequences delivered from the discrete pulse sequence calculator 463, the multiplexer 4641 is supplied with a unit pulse through an input terminal 4640. The input pulse is a pulse of a zero delay (one pulse alone rather than a sequence) in view of the fact that a waveform sequence of the zero delay gives, as it is, an impulse response waveform supplied from the impulse response calculator 462.

The multiplexer 4641 successively switches the three pulse sequences and the unit pulse for storage in the pulse sequence memory 4642. In the example being illustrated for use in practice, the pulse sequence memory 4642 has a memory area of a size of (13, 4) with thirteen taps used as an effective length of the pulse sequences. The pulse sequence memory 4642 is read out at relevant time to the excitation source pulse generator 465 depicted in FIG. 10.

In the example illustrated with reference to FIG. 11, it is possible to upsample a sequence of the autocorrelation coefficients in producing sequences of the cross-correlation coefficients. In this event, an upsampling LPF is used with its band-limiting frequency decided in theory at twice a band-limiting frequency used in sampling the input speech signal, namely, at 6.8 kHz (twice 3.4 kHz). It is, however, possible with no problem in practice to use the band-liming frequency used in sampling the input speech signal as it stands.

Turning back to FIG. 10, the description will be continued as regards the above-mentioned third example of the multipulse waveform synthesizer 45. Produced by the decoder 44 of FIG. 5, the decoded multipulse information is delivered to the excitation source pulse generator 465 of FIG. 10. In the manner described before, the decoded multipulse information represents the positions and the amplitudes of pulses. The positions are specified as discrete values at four divisions of each sampling interval for the input speech signal.

In accordance with delays from the sampling instants, the excitation source pulse generator 465 reads from the excitation source pulse memory 464 pertinent pulse sequences (including the unit pulse) with addition of amplitude information as excitation source information, which is a sample sequence of 8 kHz. Supplied with the excitation source information, the LPC synthesis filter 466 synthesizes a synthesized speech signal. Produced by the LPC synthesis filter 466, the synthesized speech signal is delivered to the D/A converter 112 and is digital to analogue converted to a continuous analogue speech signal for supply to the output terminal 15.

Figure 12:
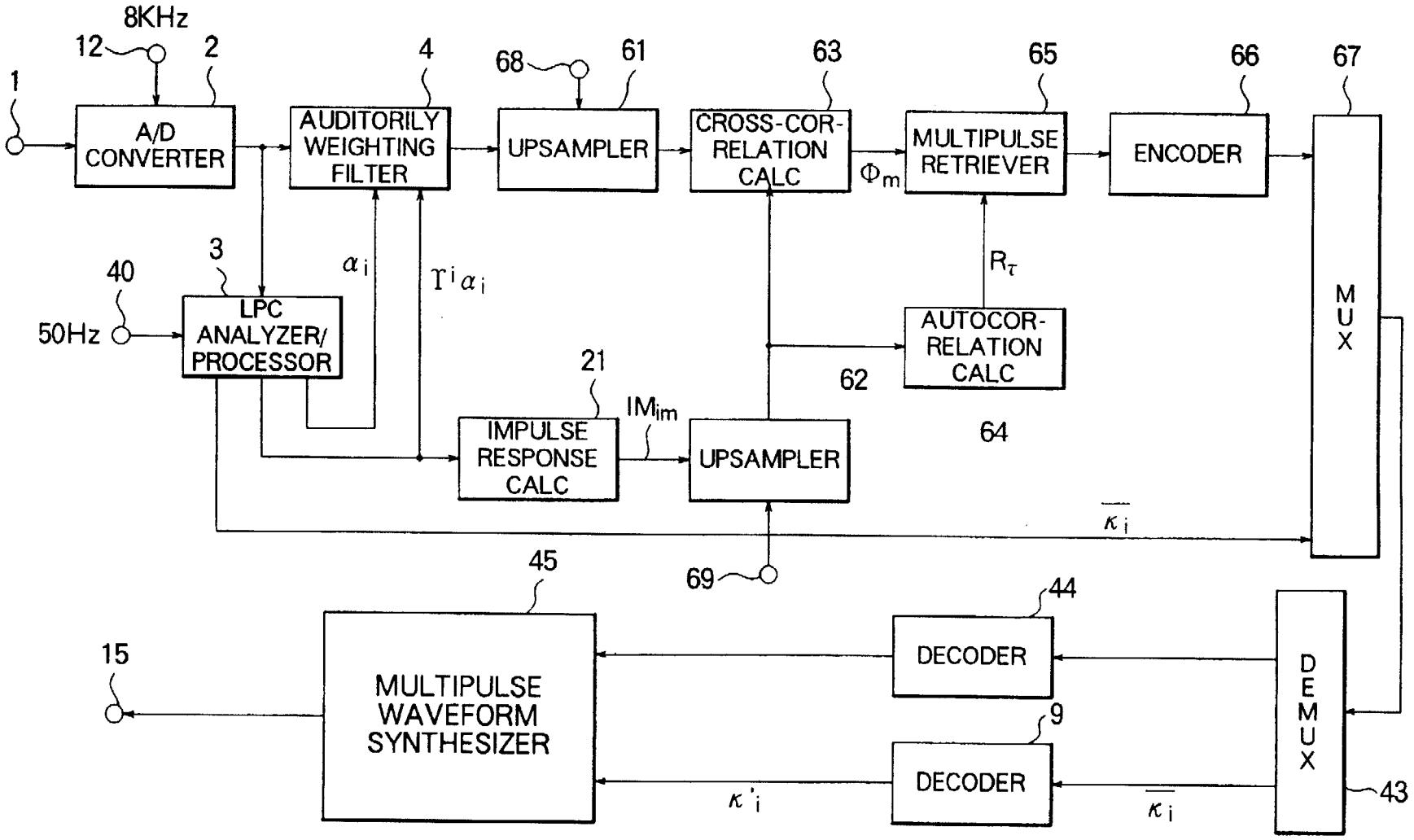
FIG. 12 is a block diagram of a multipulse processing device for carrying out a multipulse processing method according to a second embodiment of this invention.

Referring now to FIG. 12, description will proceed to a multipulse processing method according to a second embodiment of this invention. In the figure, similar parts are designated by like reference numerals as in FIG. 5 with their description omitted. In the embodiment depicted in FIG. 12, an analyzing side comprises the A/D converter 2, the LPC analyzer/processor 3, the auditorily weighting filter 4, the impulse response calculator 21, upsamplers 61 and 62, a cross-correlation calculator 63, an autocorrelation calculator 64, a multipulse retriever 65, an encoder 66, and a multiplexer 67.

In operation of the analyzing side, a sampled speech signal of 8-kHz samples is auditorily weighted by the auditorily weighting filter 4 and upsampled for supply to the cross-correlation calculator 63 by the upsampler 61 which is supplied with an analysis reference clock signal delivered through an input terminal 68 at, for example, 32 kHz.

An impulse response waveform $IM_{im}$ of 8-kHz samples is produced by the impulse response calculator 21, upsampled by the upsampler 62 by the analysis reference clock signal supplied through an input terminal 69 as at 32 kHz, and then delivered to the cross-correlation calculator 63 and the autocorrelation calculator 64. The cross-correlation calculator 63 calculates, for delivery to the multipulse retriever 65, a sequence of cross-correlation coefficients between two waveform sequences supplied from the upsamplers 61 and 62. The autocorrelation calculator 64 calculates for supply to the multipulse retriever 65 a sequence of autocorrelation coefficient of the waveform sequence delivered from the upsampler 62.

Based on these cross-correlation coefficient sequence and the autocorrelation coefficient sequence, the multipulse retriever 65 retrieves multipulses in accordance either with the above-mentioned correlation processing or with the similarity measure revealed by the present inventor. The upsamplers 61 and 62 being used, positions of the multipulses are represented by discrete values at four times the sampling frequency used for the input speech signal.

The encoder 66 quantizes and subsequently encodes the amplitudes and the positions of the multipulses for delivery to the multiplexer 67. For delivery through a transmission channel towards a synthesizing side, the multiplexer 67 multiplexes quantized data and the quantized k parameters delivered from the LPC analyzer/processor 3.

Figure 13:
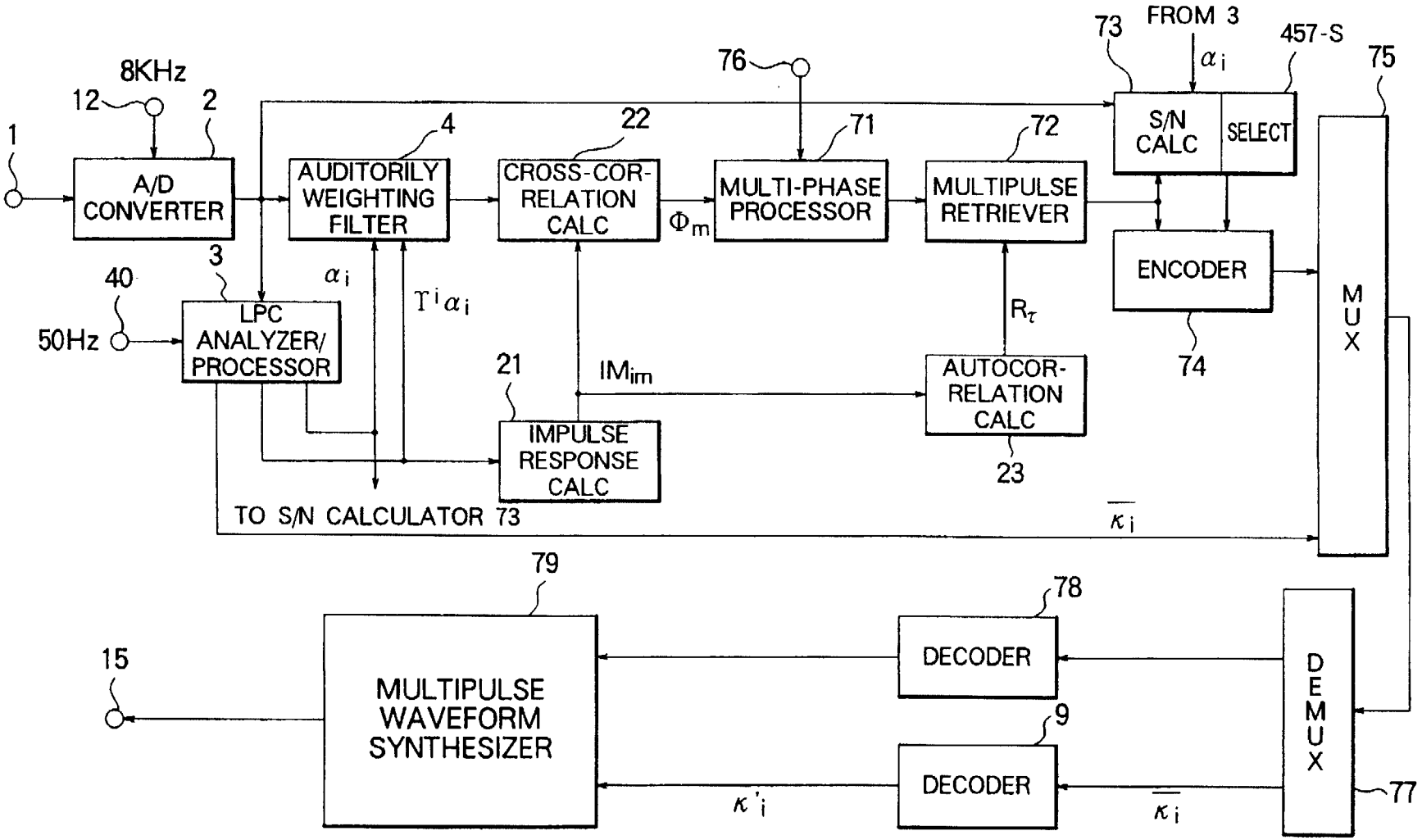
FIG. 13 is a block diagram of a multipulse processing device for carrying out a multipulse processing method according to a third embodiment of this invention.

Referring afresh to FIG. 13, the description will proceed to a multipulse processing method according to a third embodiment of this invention. In the figure, similar parts are designated by like reference numerals as in FIG. 5 with their description omitted. In FIG. 13, an analyzing side comprises the A/D converter 2, the LPC analyzer/processor 3, the auditorily weighting filter 4, the impulse response calculator 21, the cross-correlation calculator 22, the autocorrelation calculator 23, a multiphase processor 71, a multipulse retriever 72, an S/N calculator 73, the encoder 9, an encoder 78, and a multiplexer 79.

In operation of this embodiment, cross-correlation coefficients $\phi_m$ are produced by the cross-correlation calculator 22 as a sample sequence of 8 kHz and multiphase processed at the multiphase processor 71 by an analysis reference clock signal supplied through an input terminal 76. It is possible readily to implement this multiphase processing by a method used in the U/D samplers 457-1 to 457-NQ (FIG. 9). In the embodiment being illustrated, the analysis reference clock signal has four times the sampling frequency of 8 kHz, namely, 32 kHz. Consequently, the multiphase processor 71 produces, for supply to the multipulse retriever 72, four sequences of 8-kHz sampled cross-correlation coefficients $\phi_m$ with phase differences of 90°.

Supplied with these four-phased sequences of cross-correlation coefficients $\phi_m$ and the autocorrelation coefficients $R_\tau$ from the autocorrelation calculator 23, the multipulse retriever 72 retrieves multipulses phase by phase in the manner known in the art. Retrieved, four sets of multipulses are delivered to the S/N calculator 73 and to the encoder 74. Including the above-described LPC synthesis filter 466 (FIG. 10) as a built-in LPC synthesis filter, the S/N calculator 73 produces four synthesized Outputs by using the $\alpha$ parameters $\alpha_i$ supplied from the LPC analyzer/processor 3 and the four sets of multipulses supplied from the multipulse retriever 72.

Among the four synthesized outputs, one has sampling points in coincidence with sampling instants of sampling the input speech signal into the sampled speech signal. Three others have sampling instants different from the sampling instants of the sampled speech signal.

Furthermore, the S/N calculator 73 includes three U/D samplers similar to the U/D samplers 457-1 to 457-NQ for up-down sampling three synthesized outputs of the sampling instants different from the sampling instants of the sampled speech signal. The sampling instants are thereby brought into coincidence with the sampling instants of the sampled speech signal.

Subsequently, the S/N calculator 73 calculates a signal to noise ratio (S/N) of the sampled speech signal delivered from the A/D converter 2 and the four sets of synthesized outputs which have the sampling instants coincident with the sampling instant of the sampled speech signal. For the S/N, the sampled speech signal used as a signal with a difference between the synthesized outputs and the sampled speech signal used as noise in the known manner per analysis frame. Furthermore, the S/N calculator 73 includes a selecting degree 457-S for selecting the multipulses having a best S/N and supplies the encoder with data specified thereby.

The encoder 74 quantizes and encodes, among the four sets of multipulses supplied from the multipulse retriever 72, only those specified by the data specified by the S/N calculator 73. Encoding the multipulses per se, the encoder 74 delivers such encoded multipulses to the multiplexer 77. For delivery towards the demultiplexer 77 through the transmission channel, the multiplexer 75 multiplexes the encoded multipulses and the quantized k parameters delivered from the LPC analyzer/processor 3.

Supplied with multiplexed information, the demultiplexer 77 delivers the quantized k parameters to the decoder 9 and supplies the decoder 78 with the quantized multipulses and specifying data demultiplexed from the multiplexed information. The decoder 78 decodes the quantized multipulses and the specifying data for supply to the multipulse waveform synthesizer 79. Decoded, the specifying data specify how the multipulses are related in each analysis frame to the sampling points of the sampled speech signal.

Using the multipulses which have sampling points variable in analysis frames, the multipulse waveform synthesizer 79 synthesizes a speech waveform. In contrast to the multipulse waveform synthesizer 45 which is described in connection with FIG. 5 and supplied with the multipulses having sampling instants variable per pulse of the multipulses, the multipulse waveform synthesizer 79 is supplied with the multipulses of sampling points which are variable per analysis frame. It is therefore possible to implement the multipulse waveform synthesizer 79 with no changes to the multipulse waveform synthesizer 45, for example, by the structure illustrated with reference to FIG. 8.

Different from the first and the second embodiments, the third embodiment gives the degree of freedom to the appearance time instants of the multipulses per analysis frame relative to the sampling points of the sampled speech signal. In the third embodiment, the appearance time instants are slightly less constrained to the sampling points to result in a slightly deteriorated encoding efficiency than in the first and the second embodiments. An increase in the number of bits for quantization is, however, per analysis frame and very small.

Figure 14:
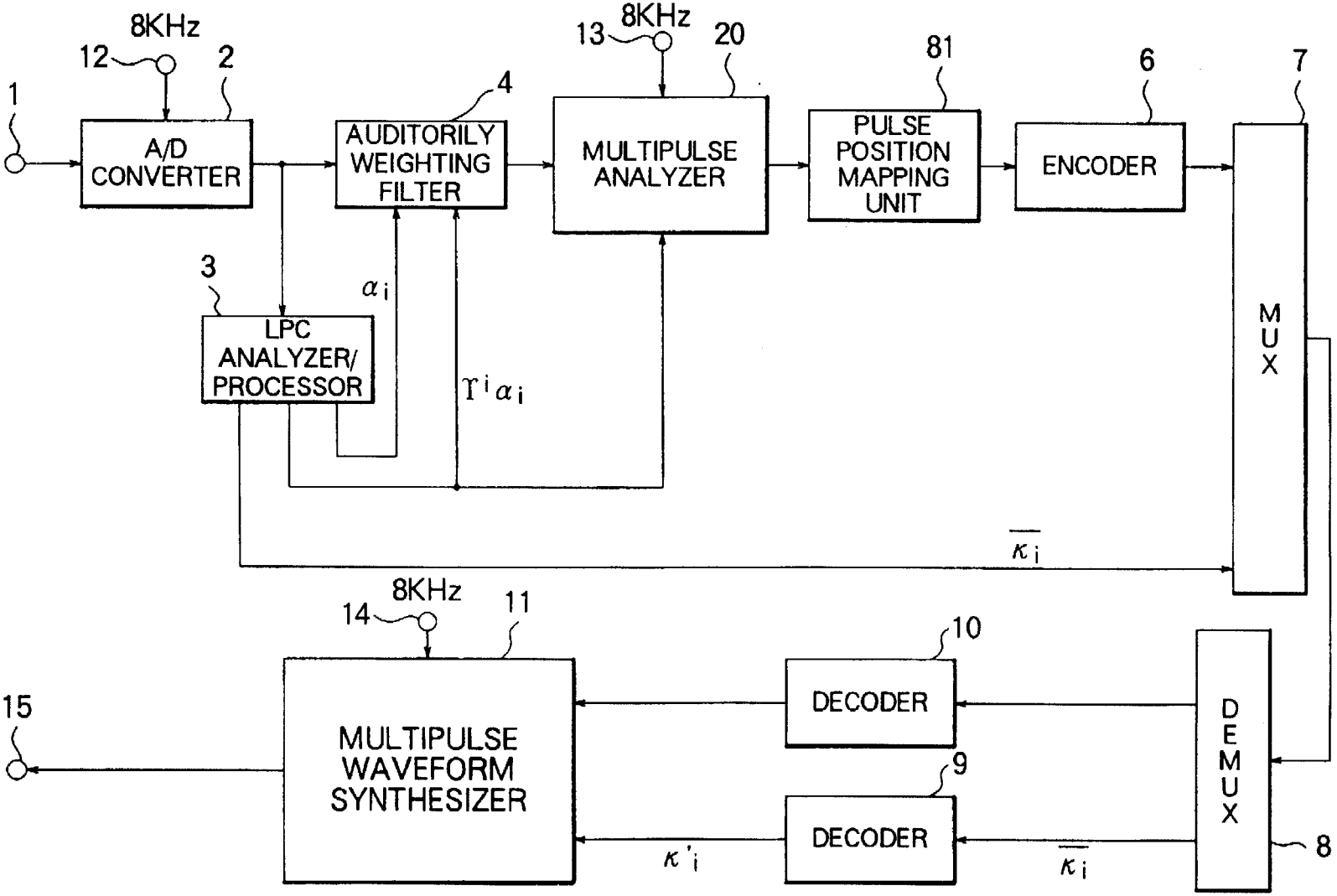
FIG. 14 is a block diagram of a multipulse processing device for carrying out a multipulse processing method according to a different embodiment of this invention.

Referring to FIG. 14, attention will be directed to a different embodiment of a method of giving a degree of freedom to appearance time instants according to a multipulse processing method of a different embodiment of this invention. In the figure, similar parts are designated by like reference numerals as in FIGS. 1 and 4 with their description omitted. In FIG. 14, a synthesizing side has a structure of the synthesizing side of prior art described in conjunction with FIG. 4. This embodiment is featured by an analyzing side which comprises a pulse position mapping unit 81.

For delivery to the pulse position mapping unit 81, the multipulse analyzer 20 produces multipulses having their positions given a degree of freedom relative to the sampling points. In the manner which will later be described, the pulse position mapping unit 81 maps positions of the multipulses onto the sampling points. This embodiment raises an efficiency of detection of the multipulses by allowing the multipulse to have a degree of freedom relative to the sampling points and prevents quantization bits from increasing by mapping the pulse positions onto the sampling points.

Figure 15:
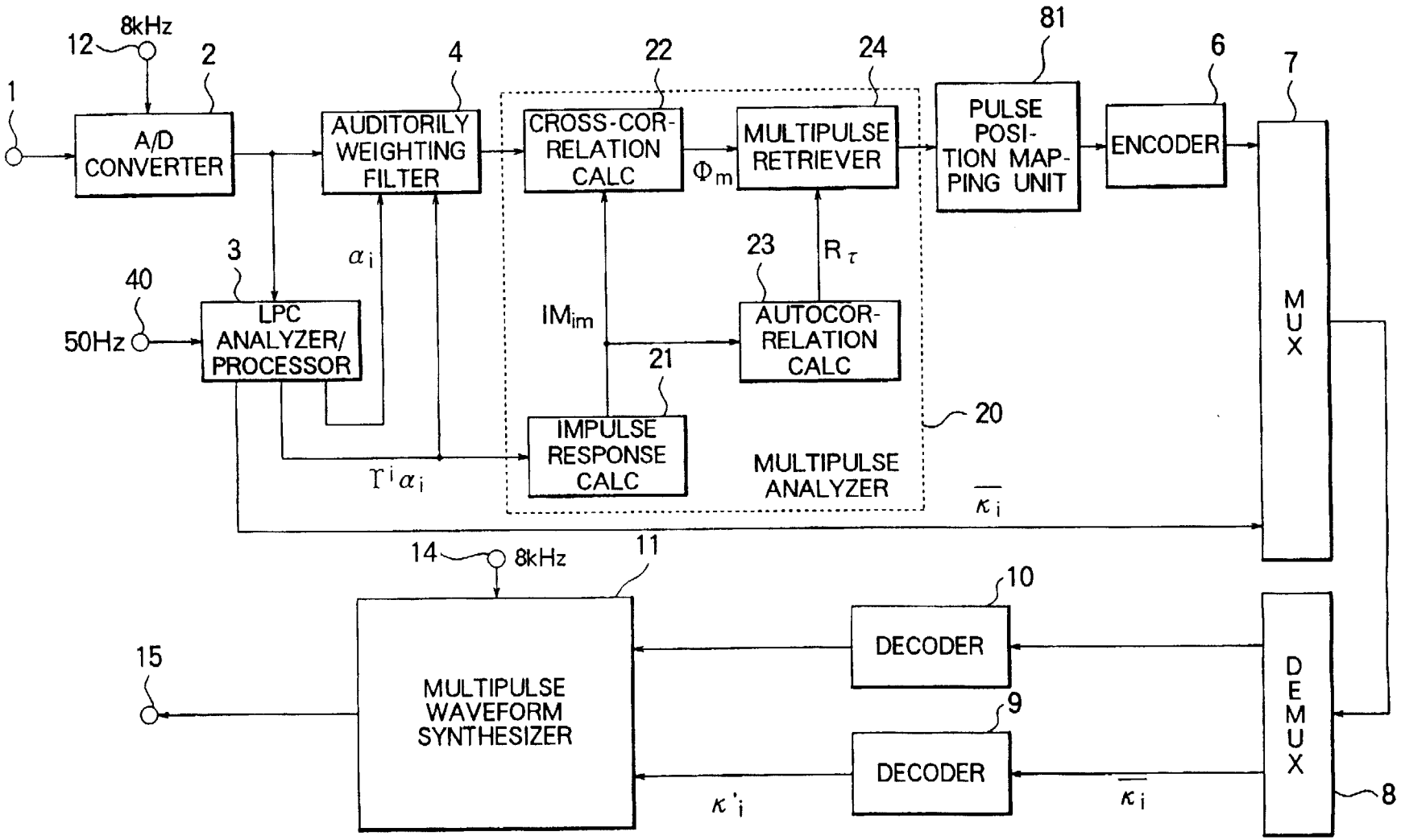
FIG. 15 is a block diagram of a multipulse processing device for carrying out a multipulse processing method according to a fourth embodiment of this invention.

Referring now to FIG. 15, the description will proceed to a multipulse processing method according to a fourth embodiment of this invention. In the figure, similar parts are designated by like reference numerals as in FIGS. 1 and 5 with their description omitted. This embodiment shows details of the block diagram of FIG. 14. In FIG. 15, an analyzing side comprises the A/D converter 2, the LPC analyzer/processor 3, the auditorily weighting filter 4, the multipulse analyzer 20, the pulse position mapping unit 81, the encoder 6, and the multiplexer 7. The multipulse analyzer 20 has a structure of the multipulse analyzer 20 of FIG. 5.

As described before, the analyzing side is featured by the pulse position mapping unit 81. An object of this will be detailed together with decision of a mapping function.

Figure 16:
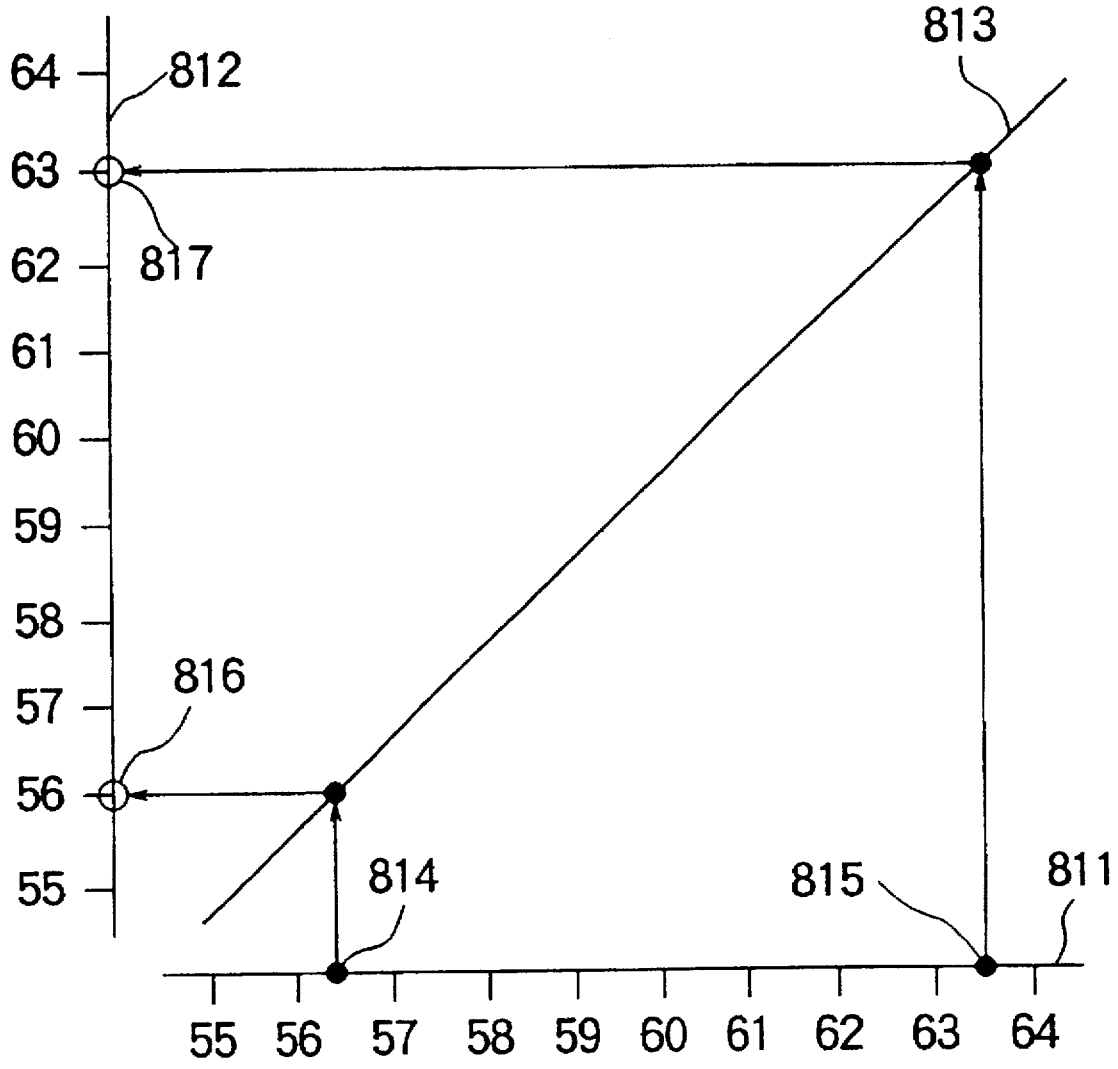
FIG. 16 is a diagram for use in describing an object of a pulse position mapping unit of a multipulse processing device of FIG. 15.

Referring to FIG. 16, the object of the pulse position mapping unit 81 (FIG. 15) will first be described. In FIG. 16, an abscissa 811 shows time positions (to be mapped pulse positions) of the multipulses produced by the multipulse analyzer 20 (FIG. 15) and delivered to the multipulse position mapping unit 81. An ordinate 812 shows time positions (mapped pulse positions) of multipulses produced by the pulse position mapping unit 81.

A line segment 813 shows the mapping function for the abscissa onto the ordinate. As analyzed by the multipulse analyzer 20, multipulse positions are exemplified by black circles at 814 and 815. Produced by the pulse position mapping unit 81, multipulse positions are indicated by white circles at 816 and 817. Represented by the black circles at 814 and 815, the pulse positions have the degree of freedom relative to sampling points defined by the sampling frequency. The pulse position 814 is at 56.25. The pulse position 815 is at 63.375. These are mapped by the mapping function onto the ordinate. For the pulse position 814, a mapped position is at 56.00 of the white circle 816. For the pulse position 815, another mapped position is at 63.00 of the white circle 817.

In this manner, the object of the pulse position mapping unit 81 is to map onto most possible vicinities of the sampling points the positions at which the multipulses have the degree of freedom relative to the sampling points of the sampling frequency. Results are delivered to the encoder 6 (FIG. 15) as integers. In this event, a problem arises about how to decide the mapping function. On deciding the mapping function, it is necessary that the following should be taken into consideration.

(1) To reduce a difference between the pulse position to be mapped and the mapped pulse position.

(2) To reduce as far as possible a variation in a difference between each pair of the pulse positions to be mapped and the mapped pulse positions. That is, the mapping function gives a displacement to each pulse position. As a result, the synthesizer waveform is lengthened or shortened in each analysis frame on the synthesized side. In view of this modulation effect, the variation should be smallest possible.

Turning to FIG. 17, the manner of decision of the mapping function of FIG. 16 will be described. In FIG. 17, an abscissa 818 shows the pulse positions to be mapped among 160 samples obtained at 8 kHz in a multipulse analysis frame. An ordinate 819 shows the difference of each sampling point and the pulse position to be mapped, namely, a time interval corresponding to each displacement of the pulse position (pulse position displacement). Black circles 820-1 to 820-7 show samples to be mapped. A straight line 821 exemplifies the mapping function. Examples are as follows. A sample is depicted by the black circle 820-4 at 56.25 and is to be mapped. A time interval for its displacement is minus 0.25. Another sample is depicted by the black circle 820-5 at 63.375 is to be mapped. Another time interval for its displacement is minus 0.375.

An example is as follows how the mapping function 821 is logically decided. It is possible to calculate a regressive function of the pulse positions depicted by the black circles 820-1 to 820-7. When represented by a straight line, the regressive function is decided by minimization of square errors. Let the mapping function be represented by a straight line:

$$y=ax+b.$$

In correspondence to the black circles 820-1 to 820-7, the pulse positions and their differences from the sampling points will be denoted by $(x_1, y^1)$, $(x_2, y^2)$, . . . , and $(x_7, y^7)$. A total sum E of squares of differences is as follows between deviations $y_1$, $y_2$, . . . , and $y_7$ and the straight line:

$$E=\sum_{i=1}^{7}(y_i-ax_i-b)^2. \tag{8}$$

Partial differentiation of E by a and b of results in the following equations.

$$\partial E/\partial a=2\sum_{i=1}^{7}x_i(y_i-ax_i-b), \tag{9}$$

and $$\partial E/\partial b=2\sum_{i=1}^{7}(y_i-ax_i-b). \tag{10}$$

The following simultaneous equations are derived by rearranging these equations with their left-hand sides rendered equal to zero.

$$\left.\begin{aligned} a\sum_{i=1}^{7}x_i^2+b\sum_{i=1}^{7}x_i&=\sum_{i=1}^{7}x_iy_i,\\ a\sum_{i=1}^{7}x_i+b_i&=\sum_{i=1}^{7}y_i,\end{aligned}\right\} \tag{11}$$

The simultaneous Equations (11) decide the straight line:

$$y=ax+b.$$

It should be noted, when the mapping function is decided independently for the analysis frames, that the synthesized waveform may be discontinuous at a frame end to deteriorate speech quality. This problem is readily solved by a mapping function which is continuous between the frames. More specifically, the mapping function should be equal to y(0) at the end of a previous frame with the mapping function rendered equal to y(0) at a beginning of a current frame. Namely, b is made equal to y(0) in the mapping function of the straight line:

$$y=ax+b.$$

In this event, a is decided by simply substituting y(0) for b in Equation (9).

Turning back to FIG. 15, the pulse position mapping unit 81 is used in the fourth embodiment. This makes it possible to quantize the multipulses produced with the degree of freedom relative to sampling points of the sampling frequency by a bit number which is used in quantizing conventional multipulses analyzed with constraint to the sampling points. The synthesized output may be subjected in this event to modulation at macroscopic time instants and, however, microscopically keeps an original waveform to give no adverse auditory effects to the speech quality. Incidentally, it is possible to make the pulse position mapping unit 81 produce its outputs at discrete points between sampling points of the sampling frequency.

This invention is not restricted to the embodiments thus far described. For example, it is possible in FIG. 7 to make the extremum calculator 243 calculate the time positions and the amplitudes of extrema from data of two or more samples preceding and following each extremum, such as four or more samples, rather than the time positions and the amplitudes of the extrema from the data of three samples consisting each extremum and two samples preceding and following the extremum.

It is furthermore possible in FIG. 15 to apply the pulse position mapping unit 81 to whichever multipulses having the degree of freedom relative to the sampling points rather than to those produced by the correlation processing.

Referring to FIGS. 18(A) to (I), functions will be described of this invention in contrast to prior art. FIG. 18(A) exemplifies at (a) the autocorrelation coefficients $R_\tau$ of the impulse response observed between a minus 20-th tap and a plus 20-th tap (for example, between minus 2.5 ms and plus 2.5 ms). Here, plus 2.5 ms (minus 2.5 ms) show an impulse response delayed (advanced) by 2.5 ms relative to another impulse response used as a reference. FIG. 18(B) exemplifies at (b1) the cross-correlation coefficients $\phi_m$ between the sampled speech signal and the impulse response for an interval of 40 taps (5 ms).

According to the conventional method, the multipulses are retrieved by first retrieving a greatest value of the cross-correlation coefficients. The greatest value appears at the minus first tap in the cross-correlation coefficients depicted in the figure (B) at (b1). FIG. 18(C) shows at (c1) a first pulse having an amplitude proportional to the greatest amplitude. Subsequently, the cross-correlation coefficients (b1) are corrected by using the autocorrelation coefficients (a) and an appearance time instant and the amplitude of the pulse (c1). FIG. 18(D) shows at (b2) the cross-correlation coefficients thereby obtained. This correction is carried out by merely subtracting from the cross-correlation coefficients the autocorrelation coefficients weighted by the amplitude of the pulse.

Thereafter, a greatest value of the corrected cross-correlation coefficients (b2) is retrieved. The greatest value of the cross-correlation coefficients (b2) is present at a tap position of zero. As a consequence, a second pulse (c2) is placed at the tap position of zero with an amplitude proportional to this greatest value. FIG. 18(E) shows the first pulse (c1) and the second pulse (c2). FIG. 18(F) shows at (b3) different cross-correlation coefficients (b3) into which the cross-correlation coefficients (b2) are corrected by the autocorrelation coefficients (a) and an appearance time instant and the amplitude of the pulse (e2). In the conventional method, such procedures are repeated a predetermined number of times.

As seen from FIG. 18(E), the first pulse (c1) and the second pulse (c2) are spaced apart by at most one tap interval. It would consequently be possible to select such pulses effectively with a smaller number of pulses if the input speech signal were sampled with sampling instants not fixed. This fact is taken into account in the invention.

More particularly, a degree of freedom is given in this invention to appearance time instants of an impulse sequence relative to the sampling instants of the sampled speech signal. FIG. 18(G) exemplifies at (d1) the cross-correlation coefficients. In FIG. 18(G), a waveform represents a partial interval of the cross-correlation coefficients $\phi_m$ which are calculated by using a sampled speech waveform at a sampling frequency of 8 kHz with the input speech signal given a delay of a half tap (for example, 62.5 microseconds). FIG. 15(H) shows at (e1) a pulse selected according to this invention at a tap position of zero at which a greatest value of the cross-correlation coefficients $\phi_m$ (d1) is retrieved. Its amplitude is proportional to the greatest value.

Next, the cross-correlation coefficients $\phi_m$ (d1) are corrected by using the autocorrelation coefficients (a) shown in FIG. 18(A) and the appearance time instant and the amplitude of the pulse (e1). FIG. 18(I) shows at (d2) the cross-correlation coefficients thereby obtained. When compared with the cross-correlation coefficients (b3) used in the conventional method, the cross-correlation coefficients (d2) represent a sufficiently suppressed sequence of cross-correlation coefficients. As a consequence, it is possible with this invention to select pulses effectively with a smaller number of pulses by suitably selecting the sampling instants for the speech signal.

In the manner thus far described, this invention makes it possible to achieve a higher encoding efficiency than prior art. This is because sampling points are optimally set for the input speech signal to enable effective pulse setting by a less number of pulses than in the prior art, to avoid use of a high sampling frequency for the input speech signal, and to result in a greater degree of freedom of the positions of multipulses. This gives a higher efficiency to the multipulses for use as the excitation source information used in the speech information in multipulse encoding. This furthermore avoids an increase in the spectrum envelope information used additionally in the speech information.

What is claimed is:

1. A multipulse processing method of multipulse encoding an input speech signal on an analyzing side into an encoded speech signal for multipulse synthesis of said encoded speech signal on a synthesizing side into a synthesized speech signal equivalent to said input speech signal, said multipulse processing method comprising on said analyzing side the steps of sampling said input speech signal into a sampled speech signal at a predetermined sampling frequency defining successive analysis frames, linear predictive coding (LPC) analyzing said sampled speech signal of each analysis frame to extract LPC coefficients and to produce original spectrum envelope information of said input speech signal based on said LPC coefficients, multipulse analyzing said LPC coefficients into a sequence of original multipulses having appearance time instants at which said original multipulses appear and multipulse amplitudes in correspondence in each analysis frame to features of excitation source information representative of speech information of said input speech signal in combination with said spectrum envelope information, and encoding said sequence of original multipulses and said spectrum envelope information into an encoded sequence of original multipulses and encoded spectrum envelope information for use in combination as said encoded speech signal, wherein said multipulse analyzing step comprises the step of giving a degree of freedom to said appearance time instants relative to sampling instants of said sampled speech signal, so that said appearance time instants are modified without increasing said predetermined sampling frequency, to modify said original multipulses into modified multipulses to make said encoded sequence comprise said modified multipulses in place of said original multipulses.

2. A multipulse processing method as claimed in claim 1, said multipulse analyzing step comprising the steps of calculating an impulse response in response to said LPC coefficients, calculating cross-correlation coefficients between said sampled speech signal and said impulse response, and calculating autocorrelation coefficients of said impulse response, wherein said freedom giving step comprises the steps of:

interpolating said autocorrelation coefficients by a greatest absolute value of maxima and minima of said cross-correlation coefficients into interpolated autocorrelation coefficients;

correcting responsive to said interpolated autocorrelation coefficients said cross-correlation coefficients into corrected cross-correlation coefficients; and repeating said interpolating step and said correcting step to repeatedly use the greatest absolute value of maxima and minima of said corrected cross-correlation coefficients a predetermined number of times and to use time positions and extremum amplitudes of maxima and minima of said corrected cross-correlation coefficients as the appearance time instants given said degree of freedom and as said multipulse amplitudes.

3. A multipulse processing method as claimed in claim 2, wherein said interpolating step comprises the steps of:

detecting, in each instance of said predetermined number of times, an extremum of said corrected cross-correlation coefficients by interpolation in at least three consecutive samples comprising one of the maxima and the minima of said corrected cross-correlation coefficients and two samples preceding and following one sampling period of said sampling frequency said one of maxima and minima of said corrected cross-correlation coefficients; and detecting, as said greatest absolute value, a greatest amplitude of the extrema detected during said predetermined number of times.

4. A multipulse processing method as claimed in claim 1, said multipulse analyzing step comprising the step of calculating responsive to said LPC coefficients an impulse response, wherein:

said multipulse analyzing step comprises the steps of:

upsampling said sampled speech signal and said impulse response into an upsampled speech signal and an upsampled impulse response at an analysis reference frequency higher than said sampling frequency;

calculating upsampled cross-correlation coefficient between said upsampled speech signal and said upsampled impulse response; and calculating upsampled autocorrelation coefficients of said upsampled impulse response; and that:

said freedom giving step comprises the step of detecting in response to said upsampled cross-correlation coefficients and said upsampled autocorrelation coefficients said modified multipulses with the appearance time instants of said original multipulses given said degree of freedom and with said multipulse amplitudes.

5. A multipulse processing method as claimed in claim 1, said multipulse analyzing step comprising the steps of calculating in response to said LPC coefficients an impulse response, calculating cross-correlation coefficients between said sampled speech signal and said impulse response, and calculating autocorrelation coefficients of said impulse response, wherein:

said multipulse analyzing step further comprises the steps of:

multiphase processing a sequence of said cross-correlation coefficients into a plurality of pulse sequences having said sampling frequency in common and different phases; and detecting a plurality of multipulse sequences in response to said autocorrelation coefficients from said pulse sequences, respectively;

said freedom giving step producing in response to said sampled speech signal and said pulse sequences said modified multipulses with the appearance time instants of said original multipulses given said degree of freedom and with said multipulse amplitudes.

6. A multipulse processing method as claimed in claim 5, wherein said freedom giving step comprises the steps of:

locally synthesizing said pulse sequences into a plurality of sampled trains of samples in concurrency with said sampled speech signal; and selecting, as said modified multipulses, the samples of one of said sampled trains that has a signal-to-noise (S/N) ratio with said sampled speech signal used as a signal and with differences between said sampled speech signal and said sampled trains used as noise.

7. A multipulse processing method as claimed in claim 1, wherein said freedom giving step reduces said degree of freedom by mapping the appearance time instants given said degree of freedom onto a time axis of sampling instants defined by said sampling frequency.

8. A multipulse processing method as claimed in claim 1, further comprising on said synthesizing side the step of decoding the encoded sequence and the encoded spectrum envelope information of said encoded speech signal into a decoded sequence of modified multipulses and decoded spectrum envelope information, wherein said multipulse processing method comprises on said synthesizing side the step of multipulse waveform synthesizing said decoded sequence of modified multipulses and said decoded spectrum envelope information into said synthesized speech signal, said multipulse waveform synthesizing step comprising the steps of:

LPC synthesizing in response to said decoded spectrum envelope information said decoded sequence of modified multipulses into a plurality of primary synthesized outputs having said sampling frequency in common and phases different depending on differences between said modified and said original multipulses;

upsampling said primary synthesized outputs by a synthesis reference clock signal of a higher frequency than said sampling frequency into secondary synthesized outputs having said higher frequency in common and said phases;

summing up said secondary synthesized outputs into a sum output of said higher frequency and a predetermined one of said phases; and D/A converting said sum output into said synthesized speech signal.

9. A multipulse processing method as claimed in claim 1, further comprising on said synthesizing side the step of decoding the encoded sequence and the encoded spectrum envelope information of said encoded speech signal into a decoded sequence of modified multipulses and decoded spectrum envelope information, said multipulse processing method being characterized by comprising on said synthesizing side the step of multipulse waveform synthesizing said decoded sequence of modified multipulses and said decoded spectrum envelope information into said synthesized speech signal, said multipulse waveform synthesizing step comprising the steps of:

LPC synthesizing in response to said decoded spectrum envelope information said decoded sequence of modified multipulses into a plurality of primary synthesized waveform trains having said sampling frequency in common and phases dependent on differences between said modified and said original multipulses;

up/down sampling said primary synthesized waveform trains, such that said primary synthesized waveform trains are up sampled in response to a synthesis reference clock signal of a higher frequency than said sampling frequency to produce upsampled primary synthesized waveform trains which are down sampled in response to timing pulse sequences having said sampling frequency in common and said phases, to generate secondary synthesized waveform trains having said sampling frequency in common and one of said phases that is specified by a predetermined one of said timing pulse sequences;

summing up said secondary synthesized waveform trains into a sum waveform sequence; and digital-to-analog (D/A) converting said sum sequence into said synthesized speech signal.

10. A multipulse processing method as claimed in claim 1, further comprising on said synthesizing side the step of decoding the encoded sequence and the encoded spectrum envelope information of said encoded speech signal into a decoded sequence of modified multipulses and decoded spectrum envelope information, wherein said multipulse processing method comprises on said synthesizing side the step of multipulse waveform synthesizing said decoded sequence of modified multipulses and said decoded spectrum envelope information into said synthesized speech signal, said multipulse waveform synthesizing step comprising the steps of:

generating trains of discrete pulses by correlation processing of said decoded spectrum envelope information, the discrete pulses of each of said trains having pulse positions corresponding to said modified pulses, the pulse positions in said trains being different in correspondence to differences between said modified and said original multipulses;

LPC synthesizing in response to said decoded spectrum envelope information and said trains of discrete pulses said decoded sequence of modified multipulses into a synthesized waveform sequence; and digital-to-analog (D/A) converting said synthesized waveform sequence into said synthesized speech signal.

11. A multipulse encoding device comprising sampling means for sampling an input speech signal into a sampled speech signal at a predetermined sampling frequency defining successive analysis frames, linear predictive coding (LPC) analyzing means for LPC analyzing said sampled speech signal of each analysis frame to extract LPC coefficients and to produce spectrum envelope information of said input speech signal based on said LPC coefficients, multipulse analyzing means for multipulse analyzing said LPC coefficients into a multipulse sequence of multipulses having appearance time instants at which said original multipulses appear and multipulse amplitudes in correspondence in each analysis frame to features of excitation source information representative of speech information of said input speech signal in combination with said spectrum envelope information, and encoding means for encoding said excitation source information into an encoded sequence to produce said encoded signal and said spectrum envelope information as an encoded speech signal, wherein said multipulse analyzing means comprises freedom giving means for giving a degree of freedom to said appearance time instants relative to sampling time instants of said sampled speech signal, so that said appearance time instants are modified without increasing said predetermined sampling frequency, to make said encoding means use the excitation source information in which the appearance time instants of said multipulses are given said degree of freedom.

12. A multipulse encoding device as claimed in claim 11, said multipulse analyzing means comprising an impulse response calculator responsive to said LPC coefficients for calculating an impulse response, cross-correlation calculating means for calculating cross-correlation coefficients between said sampled speech signal and said impulse response, and an autocorrelation calculator for calculating autocorrelation coefficients of said impulse response, wherein said freedom giving means comprises a loop comprising:

interpolating means for interpolating said autocorrelation coefficients by a greatest absolute value of maxima and minima of said cross-correlation coefficients into interpolated autocorrelation coefficients; and correcting means responsive to said interpolated autocorrelation coefficients for correcting said cross-correlation coefficients into corrected cross-correlation coefficients to repeatedly use the greatest absolute value of maxima and minima of said corrected cross-correlation coefficients a predetermined number of times and to use time positions and extremum amplitudes of the maxima and the minima of said corrected cross-correlation coefficients as the appearance time instants given said degree of freedom and as said multipulse amplitudes.

13. A multipulse encoding device as claimed in claim 12, wherein said interpolating means comprises:

extremum detecting means connected to said correcting means for detecting, in each instance of said predetermined number of times, an extremum of said corrected cross-correlation coefficients by interpolation in at least three consecutive samples comprising one of the maxima and the minima of said corrected cross-correlation coefficients and two samples preceding and following one sampling period of said sampling frequency said one of maxima and minima of corrected cross-correlation coefficients; and amplitude detecting means for detecting, as said greatest absolute value, a greatest absolute amplitude of the extrema detected during said predetermined number of times.

14. A multipulse encoding device as claimed in claim 11, said multipulse analyzing means comprising an impulse response calculator responsive to said LPC coefficients for calculating an impulse response, wherein:

said multipulse analyzing means comprises:

upsampling means for upsampling said sampled speech signal and said impulse response into an upsampled speech signal and an upsampled impulse response at an analysis reference frequency higher than said sampling frequency;

an upsampled cross-correlation calculator for calculating upsampled cross-correlation coefficients between said upsampled impulse speech signal and said upsampled response; and an upsampled impulse autocorrelation calculator for calculating upsampled autocorrelation coefficients of said upsampled response;

said freedom giving means detecting in response to said upsampled cross-correlation coefficients and said upsampled autocorrelation coefficients the multipulses having the appearance time instants given said degree of freedom and said multipulse amplitudes.

15. A multipulse encoding device as claimed in claim 11, said multipulse analyzing means comprising an impulse response calculator responsive to said LPC coefficients for calculating an impulse response, cross-correlation calculating means for calculating cross-correlation coefficients between said sampled speech signal and said impulse response, and an autocorrelation calculator for calculating autocorrelation coefficients of said impulse response, wherein:

said multipulse analyzing means further comprises:

a multiphase processor for multiphase processing a sequence of said cross-correlation coefficients into a plurality of pulse sequences having said sampling frequency in common and different phases; and a multipulse detector for detecting a plurality of multipulse sequences in response to said autocorrelation coefficients from said pulse sequences, respectively;

said freedom giving means producing in response to said sampled speech signal and said pulse sequences the multipulses with the appearance time instants given said degree of freedom and with said multipulse amplitudes.

16. A multipulse encoding device as claimed in claim 15, wherein said freedom giving means comprises:

local synthesis filters for synthesizing said pulse sequences into a plurality of synthesized outputs;

local sampling means for sampling said synthesized outputs into a plurality of sampled trains of samples sampled in concurrency with said sampled speech signal; and selecting means for selecting, as the multipulses with the appearance time instants given said degree of freedom and with said multipulse amplitudes, the samples of one of said sampled trains that has a best S/N ratio with said sampled speech signal used as a signal and with differences between said sampled speech signal and said sampled trains used as noise.

17. A multipulse encoding device as claimed in claim 16, wherein:

said selecting means produces an indicatiohn signal indicative of the samples of said one of sampled trains;

said encoding means using said sampled trains and said indication signal collectively as the excitation source information in which the appearance time instants are given said degree of freedom.

18. A multipulse encoding device as claimed in claim 11, wherein said freedom giving means reduces said degree of freedom by mapping the appearance time instants given said degree of freedom onto a time axis of sampling instants defined by said sampling frequency.

19. A multipulse encoding device as claimed in claim 18, wherein said freedom giving means gives to the appearance time instants of multipulses the degree of freedom with no changes throughout each analysis frame.

20. A multipulse decoding device for decoding an encoded speech signal produced by a multipulse encoder as a combination of an encoded sequence of modified multipulses and encoded spectrum envelope information by sampling an original speech signal into a sampled speech signal at predetermined sampling frequency defining successive analysis frames, by linear predictive coding (LPC) analyzing the sampled speech signal of each analysis frame for extraction of LPC coefficients and for production of original spectrum envelope information of said original speech signal based on said LPC coefficients, by multipulse analyzing said LPC coefficients into original multipulses having appearance time instants at which said original multipulses appear and multipulse amplitudes in correspondence in each analysis frame to features of excitation source information representative of speech information of said original speech signal in combination with said original spectrum envelope information, by modifying said original multipulses into modified multipulses of a sequence with said appearance time instants given a degree of freedom which allows said appearance time instants to be modified without increasing said predetermined sampling frequency, and by encoding said modified multipulses into said encoded sequence of modified multipulses and said original spectrum envelope information into said encoded spectrum envelope information, said multipulse decoding device comprising:

decoding means for decoding said encoded sequence into a decoded sequence of modified multipulses and said encoded spectrum envelope information into decoded spectrum envelope information; and multipulse waveform synthesizing means for synthesizing said decoded sequence of modified multipulses and said decoded spectrum envelope information into a synthesized speech signal equivalent to said original speech signal.

21. A multipulse decoding device as claimed in claim 20, wherein said multipulse waveform synthesizing means comprises:

LPC synthesizing means responsive to said decoded spectrum envelope information for processing said decoded sequence of modified multipulses into a plurality of primary synthesized outputs having said sampling frequency in common and phases dependent on differences between said modified and said original multipulses;

upsampling means for upsampling said primary synthesized outputs by a synthesis reference clock signal of a higher frequency than said sampling frequency into secondary synthesized outputs having said higher frequency in common and said phases;

summing means for summing up said secondary synthesized outputs into a sum output of said higher frequency and a predetermined one of said phases; and D/A converter means for converting said sum output into said synthesized speech signal.

22. A multipulse decoding device as claimed in claim 20, wherein said multipulse waveform synthesizing means comprises:

LPC synthesizing means responsive to said decoded spectrum envelope information for processing said decoded sequence of modified multipulses into a plurality of primary synthesized waveform trains having said sampling frequency in common and phases dependent of difference between said modified and said original multipulses;

up/down sampling means for up sampling said primary synthesized waveform trains responsive to a synthesis reference clock signal of a higher frequency than said sampling frequency to produce upsampled primary synthesized waveform trains which are down sampled in response to timing pulse sequences having said sampling frequency in common and said phases, to generate secondary synthesized waveform trains having said sampling frequency in common and one of said phases that is specified by a predetermined one of said timing pulse sequences;

summing means for summing up said secondary synthesized waveform trains into a sum waveform sequence; and digital-to-analog (D/A) converter means for converting said sum waveform sequence into said synthesized speech signal.

23. A multipulse decoding device as claimed in claim 20, wherein said multipulse waveform synthesizing means comprises:

discrete pulse generating means by correlation processing of said decoded spectrum envelope information for generating trains of discrete pulses, the discrete pulses of each of said trains having pulse positions corresponding to said modified multipulses, the pulse positions in said trains being different in correspondence to differences between said modified and said original multipulses;

LPC synthesizing means responsive to said decoded spectrum envelope information and said trains of discrete pulses for processing said decoded sequence of modified multipulses into a synthesized waveform sequence; and D/A converter means for converting said synthesized waveform sequence into said synthesized speech signal.

24. A multipulse analyzer comprising sampling means for sampling an input speech signal into a sampled speech signal at a predetermined sampling frequency defining successive analysis frames, linear predictive coding (LPC) analyzing means for LPC analyzing said sampled speech signal of each analysis frame to extract LPC coefficients and to produce spectrum envelope information based on said LPC coefficients, and multipulse analyzing means for multipulse analyzing said LPC coefficients into a multipulse sequence of multipulses having appearance time instants at which said original multipulses appear and multipulse amplitude in correspondence in each analysis frame to features of excitation source information representative of speech information of said input speech signal in combination with said spectrum envelope information, wherein said multipulse analyzing means comprises freedom giving means for giving a degree of freedom to said appearance time instants, so that said appearance time instants are modified without increasing said predetermined sampling frequency, to modify said multipulses into modified multipulses relative to sampling instants of said sampled speech signal with the appearance time instants given said degree of freedom and with said multipulse amplitudes as they are.

25. A multipulse analyzer as claimed in claim 24, said multipulse analyzing means comprising an impulse response calculator responsive to said LPC coefficients for calculating an impulse response, cross-correlation calculating means for calculating cross-correlation coefficients between said sampled speech signal and said impulse response, and an autocorrelation calculator for calculating autocorrelation coefficients of said impulse response, wherein said freedom giving means comprises a loop comprising:

interpolating means for interpolating said autocorrelation coefficients by a greatest absolute value of maxima and minima of said cross-correlation coefficients into interpolated autocorrelation coefficients; and correcting means responsive to said interpolated autocorrelation coefficients for correcting said cross-correlation coefficients into corrected cross-correlation coefficients to repeatedly use the greatest absolute value of maxima and minima of said corrected cross-correlation coefficients a predetermined number of times and to use time positions and extremum amplitudes of maxima and minima of said corrected cross-correlation coefficients as the appearance time instants given said degree of freedom and as said multipulse amplitudes.

26. A multipulse analyzer as claimed in claim 25, wherein said interpolating means comprises:

extremum detecting means connected to said correcting means for detecting, in each instance of said predetermined number of times, an extremum of said cross-correlation coefficients by interpolation in at least three samples comprising one of the maxima and the minima of said corrected cross-correlation coefficients and two samples preceding and following one sampling period of said sampling frequency said one of maxima and minima of corrected cross-correlation coefficients; and amplitude detecting means for detecting, as said greatest absolute value, a greatest absolute amplitude of the extrema detected during said predetermined number of times.

27. A multipulse analyzer as claimed in claim 24, said multipulse analyzing means comprising an impulse response calculator responsive to said LPC coefficients for calculating an impulse response, wherein:

said multipulse analyzing means comprises:

upsampling means for upsampling said sampled speech signal and said impulse response into an upsampled speech signal and an upsampled response at an analysis reference frequency higher than said sampling frequency;

an upsampled cross-correlation calculator for calculating upsampled cross-correlation coefficients between said upsampled speech signal and said upsampled response; and an upsampled autocorrelation calculator for calculating upsampled autocorrelation coefficients of said upsampled response;

said freedom giving means extracting in response to said upsampled cross-correlation coefficients and said upsampled autocorrelation coefficients the multipulses having the appearance time instants given said degree of freedom and said multipulse amplitudes.

28. A multipulse analyzer as claimed in claim 24, said multipulse analyzing means comprises an impulse response calculator responsive to said LPC coefficients for calculating an impulse response, cross-correlation calculating means for calculating cross-correlation coefficients between said sampled speech signal and said impulse response, and an autocorrelation calculator for calculating autocorrelation coefficients of said impulse response, wherein:

said multipulse analyzing means comprises:

a multiphase processor for multiphase processing a sequence of said cross-correlation coefficients into a plurality of pulse sequences having said sampling frequency in common and different phases; and a multipulse detector for detecting a plurality of multipulse sequences in response to said autocorrelation coefficients from said pulse sequences, respectively;

said freedom giving means producing in response to said sampled speech signal and said pulse sequences the multipulses having the appearance time instants given said degree of freedom and said multipulse amplitudes.

29. A multipulse analyzer as claimed in claim 28, wherein said freedom giving means comprises:

local synthesis filters for synthesizing said pulse sequences into a plurality of synthesized outputs;

local sampling means for sampling said synthesized outputs into a plurality of sampled trains of samples sampled in concurrency with said sampled speech signal; and selecting means for selecting, as the multipulses having the appearance time instants given said degree of freedom and said multipulse amplitudes, the samples of one of said sampled trains that has a best S/N ratio with said sampled speech signal used as a signal and with differences between said sampled speech signal and said sampled trains used as noise.

30. A multipulse analyzer as claimed in claim 29, wherein:

said selecting means produces an indicatiohn signal indicative of the samples of said one of sampled trains;

said encoding means using said sampled trains and said indication signal collectively as the excitation source information in which the appearance time instants are given said degree of freedom.

31. A multipulse analyzer as claimed in claim 24, wherein said freedom giving means reduces said degree of freedom by mapping the appearance time instants given said degree of freedom onto a time axis of sampling instants defined by said sampling frequency.

32. A multipulse analyzer as claimed in claim 31, wherein said freedom giving means gives to the appearance time instants of multipulses the degree of freedom with no changes throughout each analysis frame.

33. A multipulse synthesizer for multipulse synthesizing a sequence of modified multipulses and spectrum envelope information produced by a multipulse analyzer by sampling an original speech signal into a sampled speech signal at a predetermined sampling frequency defining successive analysis frames, by linear predictive coding (LPC) analyzing the sampled speech signal of each analysis frame for extraction of LPC coefficients and for production of said spectrum envelope information based on said LPC coefficients, by multipulse analyzing said LPC coefficients into original multipulses having appearance time instants at which said original multipulses appear and multipulse amplitudes in correspondence in each analysis frame to features of excitation source information representative of speech information of said original speech signal in combination with said spectrum envelope information, and by modifying said original multipulses into the modified multipulses of said sequence with said appearance time instants given a degree of freedom which allows said appearance time instants to be modified without increasing said predetermined sampling frequency, said multipulse synthesizer comprising multipulse waveform synthesizing means for synthesizing said sequence of modified multipulses and said spectrum envelope information into a synthesized speech signal equivalent to said original speech signal.

34. A multipulse synthesizer as claimed in claim 33, wherein said multipulse waveform synthesizing means comprises:

LPC synthesizing means responsive to said spectrum envelope information for processing said sequence of modified multipulses into a plurality of primary synthesized outputs having said sampling frequency in common and phases dependent on differences between said modified and said original multipulses;

upsampling means for upsampling said primary synthesized outputs by a synthesis reference clock signal of a higher frequency than said sampling frequency into secondary synthesized outputs having said higher frequency in common and said phases;

summing means for summing up said secondary synthesized outputs into a sum output of said higher frequency and a predetermined one of said phases; and D/A converter means for converting said sum ought into said synthesized speech signal.

35. A multipulse synthesizer as claimed in claim 33, wherein said multipulse waveform synthesizing means comprises:

LPC synthesizing means responsive to said spectrum envelope information for processing said sequence of modified multipulses into a plurality of primary synthesized waveform trains having said sampling frequency in common and phases dependent on differences between said modified and said original multipulses;

up/down sampling means for up sampling said primary synthesized waveform trains responsive to a synthesis reference clock signal of a higher frequency than said sampling frequency to produce upsampled primary synthesized waveform trains which are down sampled in response to timing pulse sequences having said sampling frequency in common and said phases, to generate secondary synthesized waveform trains having said sampling frequency in common and one of said phases that is specified by a predetermined one of said timing pulse sequences;

summing means for summing up said secondary synthesized waveform trains into a sum waveform sequence; and digital-to-analog (D/A) converter means for converting said sum waveform sequence into said synthesized speech signal.

36. A multipulse synthesizer as claimed in claim 33, wherein said multipulse waveform synthesizing means comprises:

discrete pulse generating means by correlation processing of said spectrum envelope information for generating trains of discrete pulses, the discrete pulses of each of said trains having pulse positions corresponding to said modified multipulses, the pulse positions in said trains being different in correspondence to differences between said modified and said original multipulses;

LPC synthesizing means responsive to said spectrum envelope information and said trains of discrete pulses for processing said sequence of modified multipulses into s synthesized waveform sequence; and D/A converter means for converting said synthesized waveform sequence into said synthesized speech signal.

* * * * *

UNITED STATES PATENT AND TRADEMARK OFFICE

CERTIFICATE OF CORRECTION

PATENT NO. : 5,696,874
DATED : December 9, 1997
INVENTOR(S) : Taguchi

It is certified that error(s) appears in the above-identified patent and that said Letters Patent is hereby corrected as shown below:

Column 3, line 39, after "multipulses" insert --are then modified--; (1st occurr.)

Column 6, line 52, delete "cress" and insert --cross--;

Column 19, line 51, delete "$(x_1,y^1)$, $(x_2,y^2)$,..., and $(x_7,y^7)$ and insert --$(x_1,y_1)$, $(x_2,y_2)$,..., and $(x_7,y_7)$--.

Signed and Sealed this

Eleventh Day of August 1998

Bruce Lehman

*Attest:*

BRUCE LEHMAN

*Attesting Officer*

*Commissioner of Patents and Trademarks*